US011180348B2

(12) United States Patent
Connell et al.

(10) Patent No.: US 11,180,348 B2
(45) Date of Patent: Nov. 23, 2021

(54) LIFTING AND JACKING APPARATUS

(71) Applicants: Illinois Tool Works Inc., Glenview, IL (US); WNL Concrete Products, LLC, Ontario, CA (US)

(72) Inventors: Robert Urquhart Connell, Melbourne (AU); Loyd E. McGhee, Jr., Ontario, CA (US); Rodney Brown, Melbourne (AU)

(73) Assignees: Illinois Tools Works Inc., Glenview, IL (US); WNL Concrete Products LLC, Ontario, CA (US)

( * ) Notice: Subject to any disclaimer, the term of this patent is extended or adjusted under 35 U.S.C. 154(b) by 0 days.

(21) Appl. No.: 16/998,552

(22) Filed: Aug. 20, 2020

(65) Prior Publication Data

US 2020/0377345 A1 Dec. 3, 2020

Related U.S. Application Data

(63) Continuation of application No. 16/052,275, filed on Aug. 1, 2018, now Pat. No. 10,752,472.

(Continued)

(51) Int. Cl.
*B66C 1/66* (2006.01)
*E04G 15/04* (2006.01)

(Continued)

(52) U.S. Cl.
CPC ..... *B66C 1/666* (2013.01); *E04B 1/3511* (2013.01); *E04C 2/044* (2013.01); *E04G 15/04* (2013.01);

(Continued)

(58) Field of Classification Search
CPC ..... B66C 1/666; E04B 1/3511; E04B 1/4121; E04C 2/044; E04C 2002/002; E04G 15/04; E04G 21/142
See application file for complete search history.

(56) References Cited

U.S. PATENT DOCUMENTS 474,885 A * 5/1892 Viett ..... B66C 1/666 294/89
821,952 A * 5/1906 Murphy et al. ..... B66C 1/666 294/89

(Continued)

FOREIGN PATENT DOCUMENTS

AU 755585 11/1999
AU 2002320664 4/2003

(Continued)

OTHER PUBLICATIONS

International Search Report and Written Opinion for International Application No. PCT/US2018/045017, dated Oct. 5, 2018 (16 pages).

(Continued)

*Primary Examiner* — Jessie T Fonseca
(74) *Attorney, Agent, or Firm* — Neal, Gerber & Eisenberg LLP

(57) ABSTRACT

A lifting and jacking apparatus including a void former configured for embedment in a concrete slab before pouring of the concrete slab and a lifting bail removably insertable in and securely attachable to the void former. The void former includes a built in jacking screw configured to assist in adjusting the height of the concrete slab.

19 Claims, 22 Drawing Sheets

Related U.S. Application Data

(60) Provisional application No. 62/543,093, filed on Aug. 9, 2017.

(51) Int. Cl.

| | |
|---|---|
| ***E04G 21/14*** | (2006.01) |
| ***E04C 2/04*** | (2006.01) |
| ***E04B 1/35*** | (2006.01) |
| *E04C 2/00* | (2006.01) |
| *E04B 1/41* | (2006.01) |

(52) U.S. Cl.

CPC ..... *E04G 21/142* (2013.01); *E04B 1/4121* (2013.01); *E04C 2002/002* (2013.01)

(56) References Cited

U.S. PATENT DOCUMENTS

| | | | | |
|---|---|---|---|---|
| 2,563,164 | A * | 8/1951 | Fletcher | E04G 21/142 294/89 |
| 2,719,747 | A * | 10/1955 | Layne | B66C 1/54 294/89 |
| 3,297,293 | A * | 1/1967 | Andrews | B66C 1/666 248/499 |
| 3,333,388 | A | 8/1967 | Sandin | |
| 3,404,503 | A * | 10/1968 | Courtois | B66C 1/666 52/701 |
| 3,431,012 | A * | 3/1969 | Eriksson | B28B 23/005 294/89 |
| 3,456,547 | A * | 7/1969 | Strong | E04B 1/4121 411/105 |
| 4,017,115 | A * | 4/1977 | Holt | B66C 1/666 294/89 |
| 4,018,470 | A * | 4/1977 | Tye | B66C 1/666 294/89 |
| 4,068,879 | A * | 1/1978 | Torbet | B66C 1/666 294/89 |
| 4,079,983 | A | 3/1978 | Van Mastrigt | |
| 4,088,361 | A | 5/1978 | Ditcher | |
| 4,179,151 | A * | 12/1979 | Tye | E04G 21/142 294/89 |
| 4,325,575 | A * | 4/1982 | Holt | B66C 1/666 294/89 |
| RE31,131 | E * | 1/1983 | Torbet | B66C 1/54 294/89 |
| 4,367,892 | A | 1/1983 | Holt | |
| 4,437,642 | A * | 3/1984 | Holt | B66C 1/66 249/175 |
| 4,512,121 | A | 4/1985 | Carydias | |
| 4,570,987 | A | 2/1986 | Wong | |
| 4,726,561 | A | 2/1988 | Worzala, Jr. | |
| 4,785,593 | A | 11/1988 | Munoz, Jr. | |
| 4,996,804 | A | 3/1991 | Naka et al. | |
| 5,248,176 | A * | 9/1993 | Fredriksson | B66C 1/66 294/215 |
| 5,261,198 | A | 11/1993 | McMillan | |
| 5,732,991 | A * | 3/1998 | Tsui | B66C 1/66 294/215 |
| 6,336,766 | B1 | 1/2002 | De Villele | |
| 6,568,730 | B1 * | 5/2003 | Paterson | B66C 1/666 294/89 |
| 6,694,680 | B2 | 2/2004 | Zambelli et al. | |
| 6,792,734 | B2 | 9/2004 | Zambelli et al. | |
| 7,213,795 | B2 | 5/2007 | Paterson | |
| 8,230,931 | B2 | 7/2012 | Rodriguez et al. | |
| 8,640,399 | B2 | 2/2014 | Fradera Pellicer | |
| 8,708,595 | B2 | 4/2014 | Tseng | |
| 8,875,471 | B2 | 11/2014 | Siqueiros | |
| 8,943,777 | B2 | 2/2015 | Espinosa | |
| 8,966,833 | B2 | 3/2015 | Ally | |
| 9,222,251 | B2 | 12/2015 | Espinosa | |
| 9,347,232 | B1 | 5/2016 | Francies, III | |
| RE46,831 | E | 5/2018 | Francies, III | |
| 10,576,868 | B1 * | 3/2020 | Gilmour | B60P 7/0807 |
| 2005/0183349 | A1 * | 8/2005 | Hansort | E04G 15/04 52/125.4 |
| 2006/0248814 | A1 | 11/2006 | Chen et al. | |
| 2011/0041449 | A1 | 2/2011 | Espinosa | |
| 2014/0026515 | A1 | 1/2014 | Espinosa | |
| 2014/0053475 | A1 | 2/2014 | Baltazar | |
| 2015/0096242 | A1 | 4/2015 | Lin | |
| 2015/0167260 | A1 * | 6/2015 | Siqueiros | E01C 5/06 404/73 |
| 2015/0284967 | A1 | 10/2015 | Kim | |
| 2017/0145684 | A1 | 5/2017 | Merrick | |
| 2017/0226702 | A1 | 8/2017 | Connell et al. | |
| 2019/0242113 | A1 | 8/2019 | Reuter | |
| 2021/0107773 | A1 * | 4/2021 | Wang | B66C 1/10 |

FOREIGN PATENT DOCUMENTS

| | | |
|---|---|---|
| DE | 7244545 | 5/1973 |
| DE | 2264431 | 4/1974 |
| DE | 10 2010 019833 | 11/2011 |
| EP | 0 565 429 | 10/1993 |
| EP | 1 115 642 | 7/2001 |
| EP | 1 217 147 | 6/2002 |
| EP | 3 056 634 | 8/2016 |
| GB | 1162476 | 8/1969 |
| GB | 2139278 | 11/1984 |
| JP | 2003112884 | 4/2003 |
| WO | WO 2014/025760 | 2/2014 |
| WO | WO 2014/031365 | 2/2014 |
| WO | WO 2014185911 | 11/2014 |
| WO | WO 2016/032718 | 3/2016 |

OTHER PUBLICATIONS

Screw thread, from Wikipedia, the free encyclopedia, retrieved from the Internet at https://en.wikipedia.org/wiki/Screw_thread, on Aug. 7, 2017 (15 pages).

* cited by examiner

LIFTING AND JACKING APPARATUS

CROSS-REFERENCE TO RELATED APPLICATION

This application is related to the following commonly owned co-pending patent application: U.S. application Ser. No. 17/001,135, entitled "LIFTING OF CONCRETE COMPONENTS".

PRIORITY

This application is a continuation of, and claims priority to and the benefit of U.S. patent application Ser. No. 16/052,275, filed on Aug. 1, 2018, which claims priority to and the benefit of U.S. Provisional Patent Application No. 62/543,093, filed Aug. 9, 2017, the entire contents of each of which are incorporated herein by reference.

BACKGROUND

It is common in the construction industry to manufacture concrete slabs of various sizes offsite from a construction site. After manufacturing concrete slabs offsite, the concrete slabs must be transferred to the construction site. To transfer the concrete slabs to the construction site, the concrete slabs are typically lifted onto the bed of a truck, transported to the construction site, lifted off of the bed of the truck, and moved to the correct location at the construction site. Since each concrete slab typically weighs several tons, multiple lifting apparatuses are typically used to assist in lifting each concrete slab.

One such known lifting apparatus used to assist in lifting a concrete slab includes a known embedded lifting base and a known threaded lifting insert. The embedded lifting base is configured to be embedded in the concrete slab when the concrete slab is manufactured. This known embedded lifting base includes an internally threaded vertically extending channel having an upper opening. Four spaced apart lifting bases are typically embedded in a manufactured concrete slab (i.e., an embedded lifting base is embedded in each quarter of the concrete slab).

This known threaded lifting insert includes a stem. The stem includes threads that are configured to threadably engage the threads of the internally threaded channel of the embedded lifting base. In operation, a separate lifting insert is threadably inserted into each embedded lifting base in the concrete slab. When the lifting inserts are properly secured in the embedded lifting bases, hooking members attached to a lifting machine (such as a crane) are attached to each lifting insert to enable the lifting machine to lift and move the concrete slab to the proper location, such as onto or off of the bed of a truck.

One problem associated with this known lifting apparatus is that installing and removing the lifting inserts from each embedded lifting base is a time-consuming and a laborious process. This is a time-consuming process since the length of the threaded stem of the lifting insert is almost equal to the thickness of the concrete slab. Inserting and removing the lifting inserts from each lifting base is especially laborious and time-consuming when many concrete slabs must be moved.

This known lifting apparatus is also configured to be used to adjust the height of concrete paving slabs on the sub-grade so that the top surface of the concrete paving slab is level with adjacent top surfaces of adjacent concrete paving slabs or pavement surfaces.

More specifically, this known embedded lifting base includes a lifting plate. The lifting plate is set into the underneath portion of the concrete slab. To adjust the height of the concrete slab, a threaded jacking rod is inserted into the internally threaded channel of the embedded lifting base. The jacking rod engages and forces the lifting plate downwardly to adjust the height of the concrete slab.

Inserting the jacking rod in the internally threaded channel of the embedded lifting base is also a time-consuming and laborious process for similar reasons as for the lifting inserts described above. Additionally, once jacking and grouting of the concrete pavement slab is completed, the jacking rod must be removed which is also time-consuming and laborious and delays the finalization of the pavement repair process.

Accordingly, an improved lifting and jacking apparatus is needed.

SUMMARY

The present disclosure provides a lifting and jacking apparatus that solves the above problems. The lifting and jacking apparatus of various embodiments of the present disclosure includes a void former and a lifting bail removably insertable in and quickly and securely attachable to the void former.

In various embodiments, the void former is configured for embedment in a concrete slab during the manufacturing process (such as before pouring of the concrete slab). In various embodiments, the void former includes a jacking plate, a connecting plate having a threaded inner surface defining a jacking screw channel, an implanted jacking screw threadably rotatable in the jacking screw channel, a lower housing, an upper housing connectable to the lower housing and configured to releasably and securely receive a lifting bail, and a fastener connectable to the jacking screw and configured to engage the jacking plate to secure the jacking screw, the lower housing, the jacking plate, and the connecting plate together for embedding in a concrete slab. In various embodiments, the jacking screw includes a lower end rotatable in an opening in the jacking plate. In various embodiments, the jacking screw defines a drive tool receiving chamber. In various embodiments, the lower housing includes a breakable flange engagable by the jacking screw when the jacking screw, the lower housing, the jacking plate, and the connecting plate are held together by the fastener. In various embodiments, rotation of the jacking screw relative to the lower housing is configured to cause the breakable flange to break and thus enable the implanted jacking screw to cause the jacking plate to move relative to the concrete slab. In various embodiments, the void former includes a seal plate positionable between the jacking plate and the connecting plate. In various embodiments, the void former includes a cap removably attachable to the upper housing.

In various embodiments, the lifting bail is configured to be quickly removably inserted and locked into the void former of the present disclosure. In various embodiments, the lifting bail is also configured to be quickly unlocked and removed from the void former of the present disclosure. In various embodiments, the lifting bail includes a main stem, a central rotatable locking pin configured to rotate from the unlocked position to the locked position and vice versa, a biasing member, a locking indicator, a handle retention cap, an encaser, a locking pin handle configured to rotate and cause the locking pin to rotate from the unlocked position to the locked position and vice versa, and a lifting handle configured to be attached to a lifting machine.

The lifting and jacking apparatus of the present disclosure is configured to be used to assist in lifting and moving a heavy object such as a concrete slab. In use, a plurality of void formers and a plurality of lifting bails are usable to assist in lifting a concrete slab. The plurality of void formers are configured to each be embedded in spaced apart areas (such as corner areas) of the concrete slab. The plurality of lifting bails are configured to be respectively quickly inserted into or positioned in and locked in the embedded void formers. After each lifting bail is locked and secured in the respective embedded void former, a lifting machine can be used to lift and move the concrete slab. After the concrete slab is positioned, each respective lifting bail is configured to be quickly unlocked and quickly removed from the respective void former.

Additionally, the void former includes a built in jacking screw that is further configured to be used to adjust the height of the concrete slab so that a top surface of the concrete slab is level to adjacent top surfaces of adjacent concrete slabs and pavements.

Other objects, features, and advantages of the present disclosure will be apparent from the following detailed disclosure, taken in conjunction with the accompanying sheets of drawings, wherein like reference numerals refer to like parts.

DETAILED DESCRIPTION

In various embodiments, the present disclosure provides a lifting and jacking apparatus. The lifting and jacking apparatus includes a void former and a lifting bail removably insertable in and quickly securely attachable to the void former. The lifting and jacking apparatus of the present disclosure is configured to be used to assist in lifting and moving a heavy object. The lifting and jacking apparatus is described herein as being configured to assist in lifting and moving a concrete paving slab. However, it should be appreciated that the lifting and jacking apparatus of the present disclosure can be configured to assist in lifting and moving other suitable heavy objects other than concrete paving slabs. For brevity, the lifting and jacking apparatus of the present disclosure may sometimes be referred to herein as the apparatus.

Figure 1:
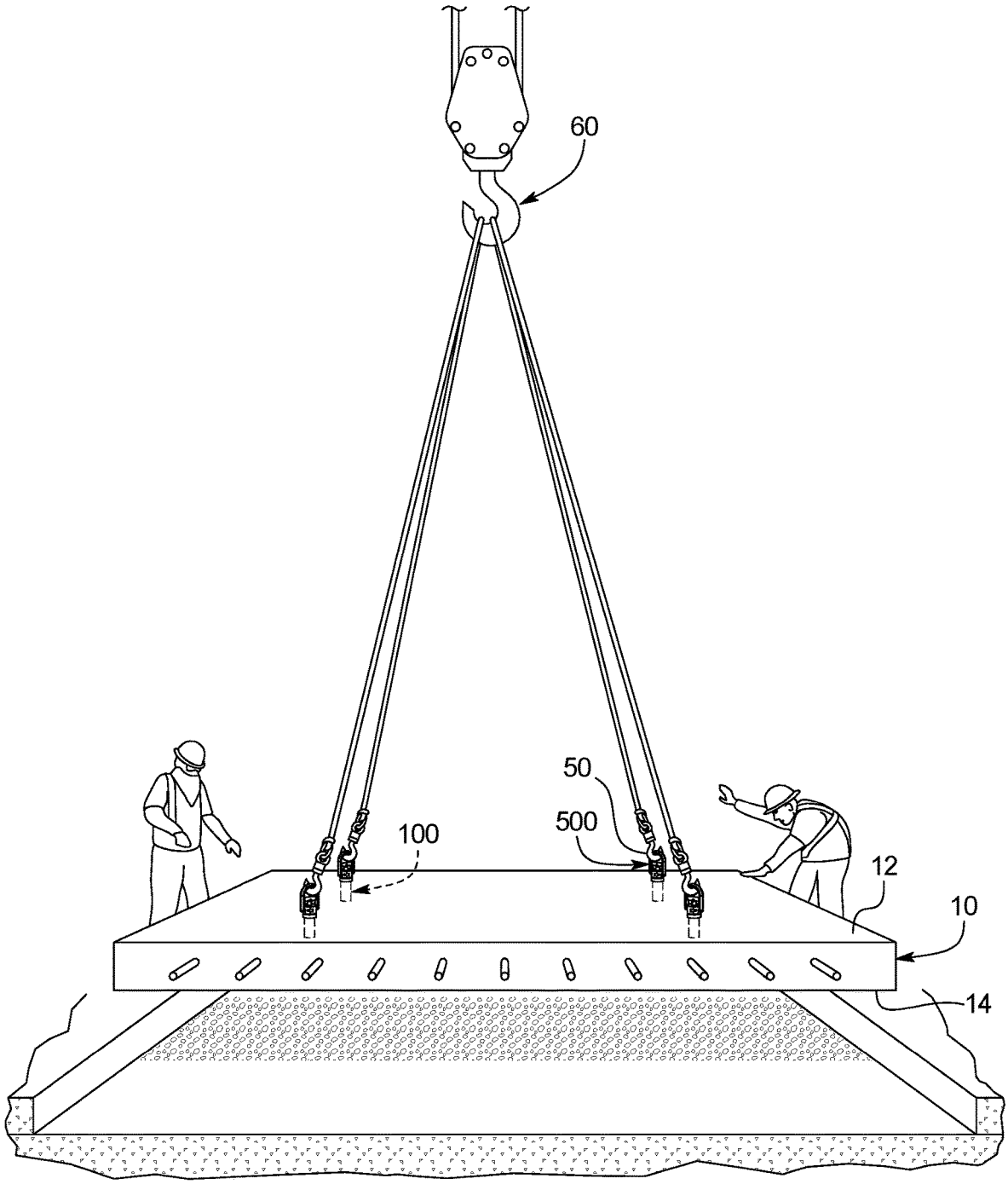
FIG. 1 is a perspective view of a concrete slab being lifted by a lifting machine (partially shown) attached by a plurality of lines to a plurality of lifting and jacking apparatus of one example embodiment of the present disclosure, wherein each jacking apparatus includes an embedded void former and a lifting bail securely but removably attached to the respective embedded void former.
Figure 2:
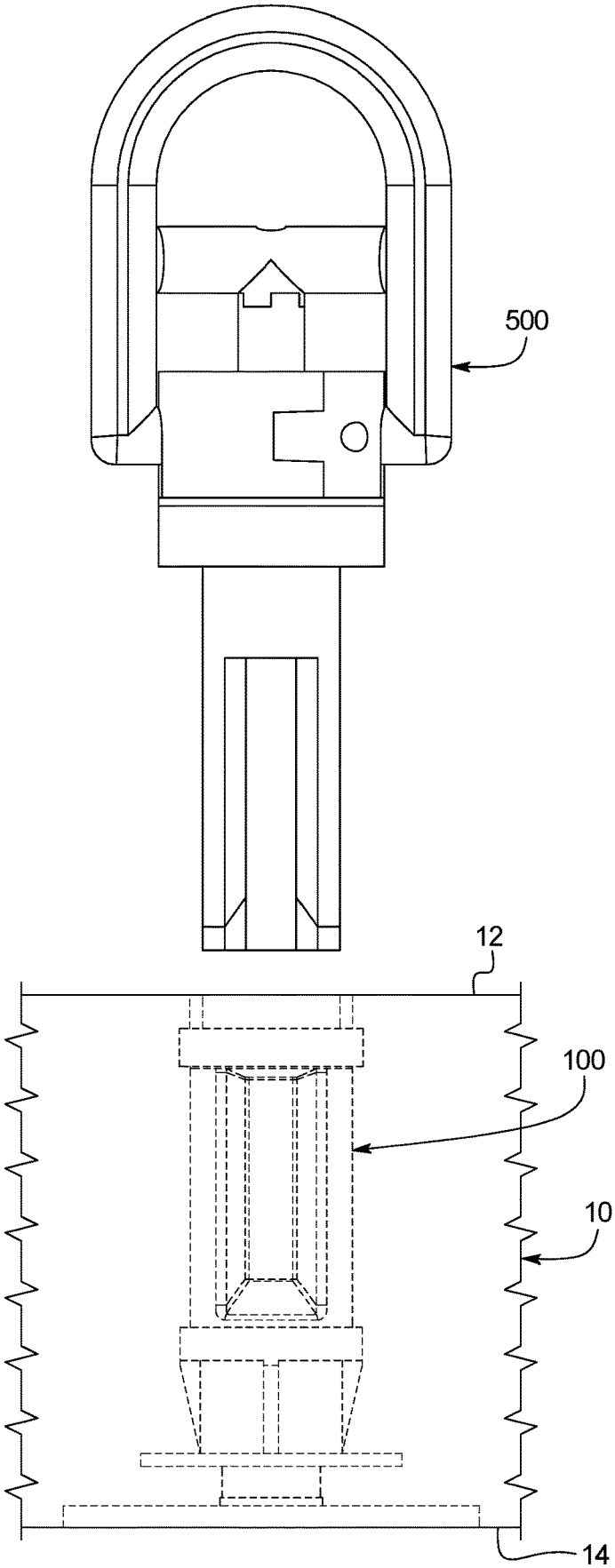
FIG. 2 is an exploded front view of one of the lifting and jacking apparatuses of FIG. 1 shown with the void former embedded in the concrete slab of FIG. 1 and the lifting bail of the lifting and jacking apparatus of FIG. 1 positioned above the void former.

Referring now to FIGS. 1 to 15, one example embodiment of the lifting and jacking apparatus of the present disclosure is generally illustrated. The apparatus of this illustrated example embodiment of the present disclosure includes a void former 100 and a lifting bail 500. FIG. 1 illustrates a plurality of void formers 100 and a plurality of lifting bails 500 being used to assist in lifting a concrete slab 10. The plurality of void formers 100 are each embedded in spaced apart areas (such as corner areas) of the concrete slab 10 for balance and stability. Each respective void former 100 has the respective lifting bail 500 inserted into or positioned in and locked in that void former 100. FIG. 2 shows one of these void formers 100 embedded in the concrete slab 10 and configured to receive a lifting bail 500. Each respective lifting bail 500 is inserted and securely locked in a respective void former 100 in FIG. 1. Each lifting bail 500 is further configured to enable a hooking member 50 that is connected to a lifting machine 60 (such as a crane which is only partially shown) to be releasably connected to the respective lifting bail 500. After each lifting bail 500 is locked and secured in each respective embedded void former 100, and each lifting bail 500 is connected to the hooking member 50 of the lifting machine 60, the lifting machine 60 can lift and move the concrete slab 10 from a first position (not shown)

to a second position (such as for a roadway, floor, or pavement as shown in FIG. 1). After the concrete slab 10 is positioned, each respective lifting bail 500 is configured to be quickly unlocked and quickly removed from the respective void former 100. Additionally, the void former 100 is further configured to be used to adjust the height of the concrete slab 10 so that a top surface 12 of the concrete slab 10 is level to adjacent top surfaces of adjacent concrete slabs or pavements as further discussed below.

VOID FORMER

Referring now to FIGS. 2, 3, 4, 5, and 6, the void former 100 of this illustrated example embodiment of the present disclosure is shown and described below in more detail. Generally, the void former 100 of this illustrated example embodiment includes: (1) a jacking plate 110; (2) a seal plate 140; (3) a connecting plate 170; (4) an implanted jacking screw 200; (5) a bottom fastener 230; (6) a lower housing 260; (7) an upper housing 290; and (8) a removable cap 334.

More specifically, the jacking plate 110 of the void former 100 is configured to assist in adjusting the height of the concrete slab, as further discussed below. The jacking plate 110 of the void former 100 includes a generally rectangular body, and particularly square due to ease of manufacture and the rotational locking effect provided by the square shape in the concrete. It should be appreciated the jacking plate 110 can be configured in other suitable shapes. The body includes a planar horizontally extending upper surface 112, a planar horizontally extending lower surface 114, and four vertically extending side edges (not labeled). The jacking plate 110 is configured to be releasably embedded in a concrete slab such that the lower surface 114 is flush with the lower surface of the concrete slab, such as a bottom surface 14 of the concrete slab 10 as shown in FIG. 2. The jacking plate 110 is further configured to be vertically moveable relative to the concrete slab to assist in adjusting the height of the concrete slab on a sub-grade. In other words, the jacking plate 110 can be initially moved downwardly and then fine adjusted upwardly or downwardly relative to the concrete slab (in which it is embedded), as further described below. In various embodiments, the jacking plate 110 is coated with one or more layers of a suitable bond breaking material on a minimum of its upper surface 112, and additionally on its four vertically extending side edges to facilitate release from the concrete slab. It should be appreciated that all surfaces of the jacking plate 110 can be coated, and in an alternative embodiment, the jacking plate can have a plastic coating, such as shrink wrap.

Figure 4:
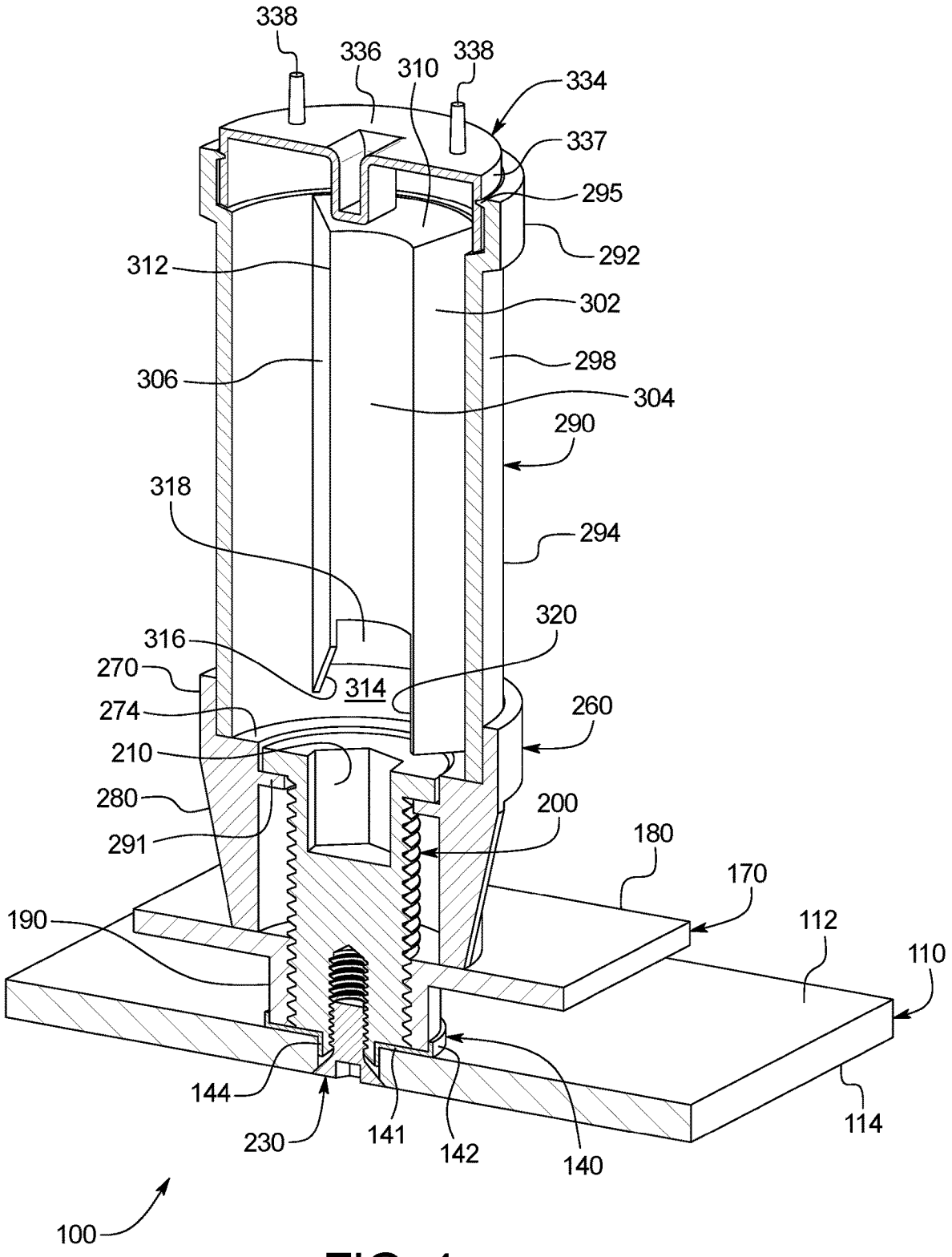
FIG. 4 is a cross-sectional perspective view of the void former of FIGS. 1 and 2 taken substantially along line 4-4 of FIG. 3.
Figure 5:
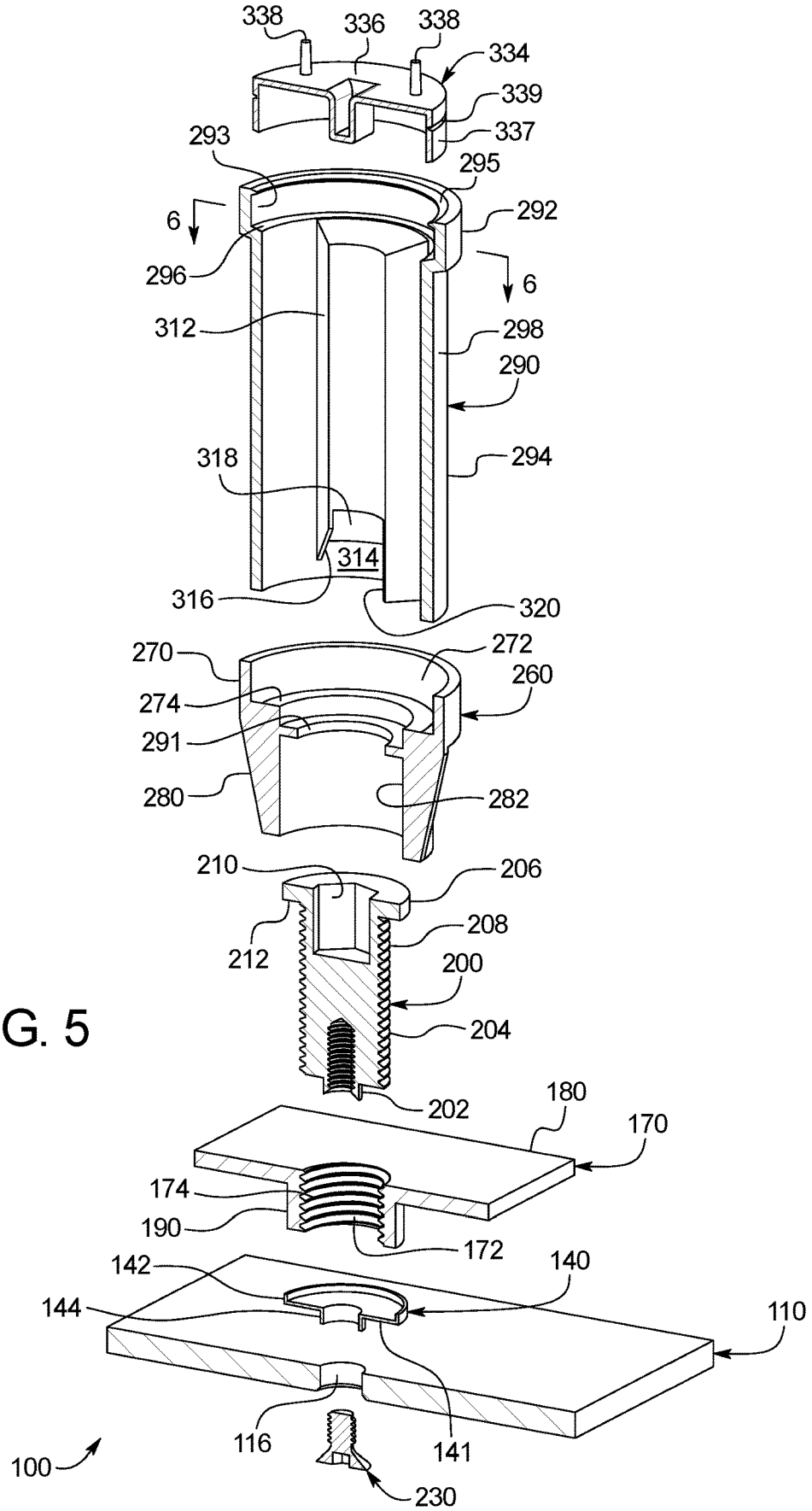
FIG. 5 is an exploded cross-sectional perspective view of the void former of FIGS. 1 and 2 taken substantially along line 4-4 of FIG. 3.

The body of the jacking plate 110 includes an inner vertically extending cylindrical wall 116 that defines a centrally positioned vertically extending cylindrical bottom fastener opening (not labeled). The bottom fastener opening is configured to receive the bottom fastener 230 (as best shown in FIGS. 4 and 5). The bottom fastener opening can also be configured to partially receive the seal plate 140 in this illustrated example embodiment and as further discussed below. The bottom fastener opening is also configured to receive a lower end 202 of the jacking screw 200.

In alternative embodiments, the jacking plate may include one or more upwardly (such as vertically extending) tapered tabs that are also configured to be releasably retained in the concrete. In such embodiments, each tab is configured to stop the jacking plate from rotating once the jacking plate is clear of the bottom of the concrete (e.g., such as the one inch thickness of the steel jacking plate). In other words, each tab acts as a spanner and holds the jacking plate in the same orientation rotationally relative to the concrete slab while being moved vertically away from the concrete slab.

The seal plate 140 is configured to prevent concrete from leaking into the bottom fastener opening of the jacking plate 110 when the void former 100 is positioned to be embedded in a newly poured concrete slab and the concrete is poured. The seal plate 140 is also configured to prevent concrete from leaking between the connecting plate 170 and the jacking screw 200 when the void former 100 is positioned to be embedded in a newly poured concrete slab and the concrete is poured. The seal plate 140 is positioned between the jacking plate 110 and the connecting plate 170. The seal plate 140 includes a horizontally extending generally cylindrical plate 141. The plate 141 of the seal plate 140 has an upper surface and a lower surface. The upper surface of the seal plate 140 engages or is engaged by the jacking screw 200 and the connecting plate 170. The lower surface engages or is engaged by the upper surface 112 of the jacking plate 110. The seal plate 140 further includes a vertically extending cylindrical upper wall 142 that is integrally connected to and upwardly extends from the plate 141. The upper wall 142 partially surrounds the lower portion 190 of the connecting plate 170. The seal plate 140 further includes a vertically extending cylindrical lower wall 144 that is integrally connected to and downwardly extends from the plate 141. The lower wall 144 partially abuts or engages a portion of the inwardly facing inner surface 116 that defines the bottom fastener opening in the jacking plate 110.

The connecting plate 170 is configured to fixedly connect members of the void former 100 to the concrete slab. More specifically, the connecting plate 170 is configured to be embedded in and mostly surrounded by the poured concrete of the concrete slab, as best shown in FIG. 2. Thus, if the concrete slab 10 moves upwardly or downwardly, the void former 100 can maintain its relative position while embedded in the concrete slab 10 (and vice versa). The connecting plate 170 includes a body. The body of the connecting plate 170 includes a generally planar horizontally extending upper portion 180. The upper portion 180 extends parallel or substantially parallel to the upper surface 112 of the jacking plate 110. Additionally, the body includes a generally vertically extending centrally positioned cylindrical lower portion 190. The lower portion 190 is connected to and extends downwardly from the upper portion 180. The bottom surface or edge of the lower portion 190 engages or is engaged by the upper surface of the plate 141 of the seal plate 140, as best shown in FIG. 4. In various embodiments, the upper portion 180 and the lower portion 190 of the connecting plate 170 are integrally connected or formed.

The upper and lower portions 180 and 190 of the body of the connecting plate 170 include a threaded vertically extending inner surface 172 that defines a vertically extending jacking screw channel. The jacking screw channel is configured to threadably receive the jacking screw 200. The jacking screw channel is further configured to enable the jacking screw 200 to be rotatable and movable upwardly and downwardly within the jacking screw channel. The inwardly facing surface 172 includes inwardly extending threads 174 that are configured to mate with or engage the complementary outwardly extending threads on the jacking screw 200, as further described below.

Figure 13:
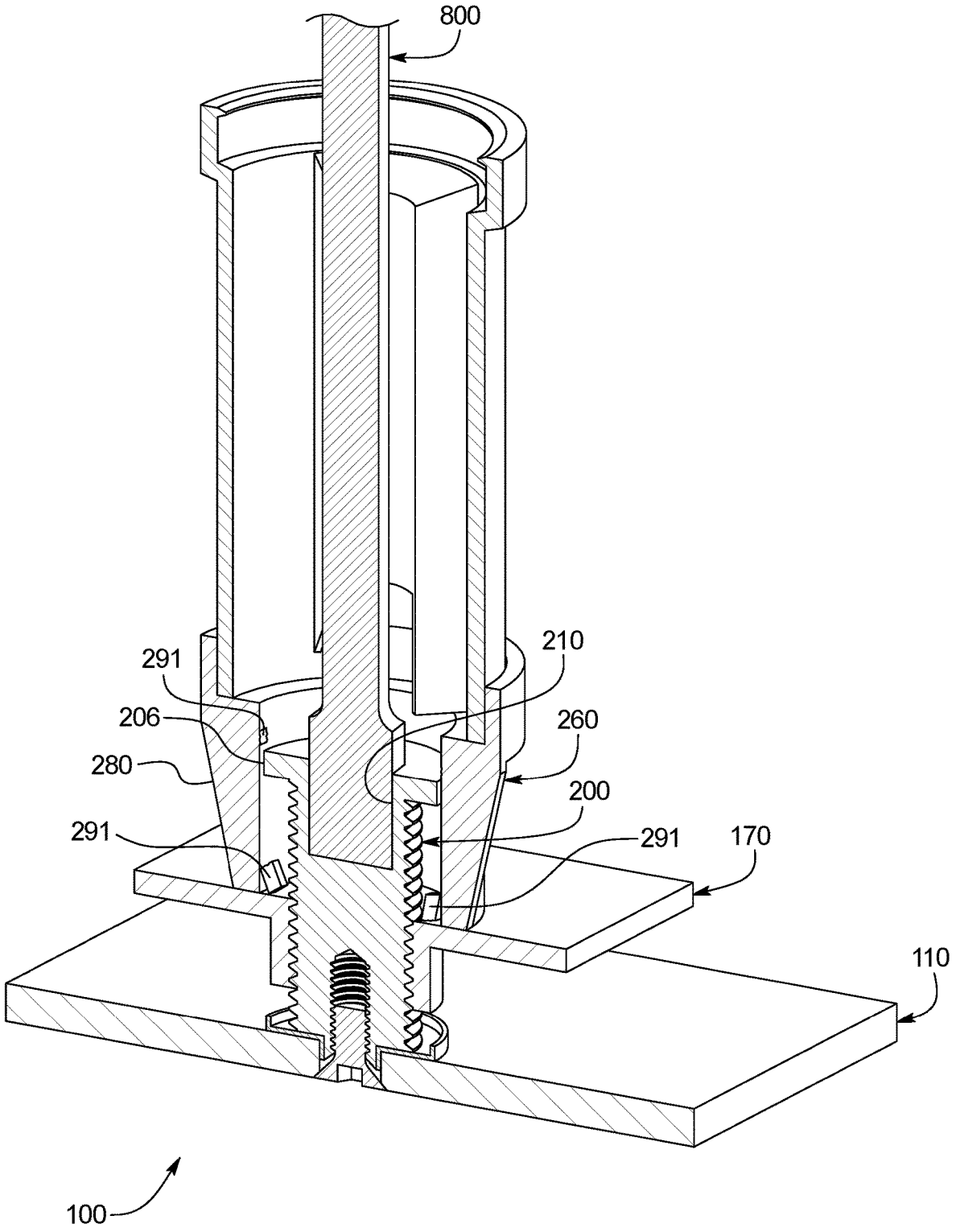
FIG. 13 is a cross-sectional perspective view showing a jacking tool engaging the jacking screw of the void former and causing the void former to adjust the height of the concrete slab.

The jacking screw 200 of the void former 100 is configured to assist in adjusting the height of the concrete slab. The jacking screw 200 can be considered implanted or permanent because it is part of the embedded void former 100 (as opposed to prior known void formers which do not include such implanted jacking screw(s)). More specifically, the jacking screw 200 of the void former 100 is configured to be rotatable within and moveable downwardly (and thereafter upwardly) within certain components of the void former 100 to cause the jacking plate 110 to move downwardly relative to the concrete slab. This causes the height of the concrete slab to be adjusted, as further described below. The jacking screw 200 includes a cylindrical lower end 202, a cylindrical shaft 204 connected to the lower end 202, and a cylindrical head 206 connected to the shaft 204. The lower end 202, shaft 204, and head 206 are all integrally connected in this illustrated example embodiment. The lower end 202 of the jacking screw 200 is configured to be positioned in the top portion of the bottom fastener opening of the jacking plate 110 and in the seal plate 140, as best shown in FIG. 4. The shaft 204 includes outwardly extending helical threads 208. The threads 208 are configured to threadably engage complementary threads 174 of the connecting plate 170, as best shown in FIG. 4. The shaft 204 and the head 206 of the jacking screw 200 include an inner hexagonal surface 210 that defines a depressed hex drive tool receiving chamber (sometimes referred to herein as a drive tool receiving chamber). It should be appreciated that the drive tool receiving chamber could be other otherwise configured such as by having a square shape, a six point shape for a TORX type tool, etc. It should also be appreciated that the head can alternatively be configured to have a suitable external shape such as hex shape that can be driven via a socket spanner type drive tool. The drive tool receiving chamber is configured to receive a driving tool such as a jacking tool 800 as shown in FIG. 13 and as further described below. The head 206 of the jacking screw 200 has a larger outer diameter than the outer diameter of the shaft 204. A lower surface 212 of the head 206 is configured to engage or be engaged by and be supported by a breakable flange 291 of the lower housing 260 of the void former 100 to assist in holding the components of the void former 100 together after assembly, during the embedding process, and until the jacking process is initiated, as further described below. Additionally, the lower end 202 and the shaft 204 include a vertically extending centrally positioned cylindrical threaded inner surface that defines a bottom fastener receiving chamber. The bottom fastener receiving chamber is configured to threadably receive the bottom fastener 230 to assist in holding the components of the void former 100 together (as shown in FIG. 4) after assembly, during the embedding process, and until the jacking process is initiated, as further described below.

The bottom fastener 230 of the void former 100 is configured be inserted into the bottom fastener opening of the jacking plate 110 and threadably received in the bottom fastener chamber of the jacking screw 200. The bottom fastener 230 includes a head that is configured to partially fit in the bottom fastener opening and the lower surface 114 of the jacking plate 110. The bottom fastener 230 is further configured to connect the jacking plate 110 and the jacking screw 200 to assist in holding the components of the void former 100 together after assembly, during the embedding process, and until the jacking process is initiated. In other words, the bottom fastener 230 maintains the relative positioning of the jacking plate 110 and the jacking screw 200 of the void former 100 before the jacking process is initiated. The bottom fastener 230 is further configured to keep the jacking screw 200 centrally aligned within the components of the void former 100.

The lower housing 260 of the void former 100 is configured to partially receive the upper housing 290. The lower housing 260 is further configured to partially hold the jacking screw 200. The lower housing 260 includes a generally vertically upwardly extending cylindrical head 270 and a radially downwardly tapered portion 280 connected to and extending downwardly from the head 270. The head 270 and the radially tapered portion 280 are integrally connected in this illustrated example embodiment.

The head 270 of the lower housing 260 includes a vertically extending inner surface 272 that defines an upper body channel. The upper body channel is configured to partially receive a bottom portion of the upper housing 290 of the void former 100 as best shown in FIG. 4. The inner surface 272 of the head 270 is configured to engage or be engaged by the bottom portion of the upper housing 290 of the void former 100 as best shown in FIG. 4. The inner diameter of the head 270 is slightly larger than the outer diameter of that bottom portion of the upper housing 290 of the void former 100 so that the upper housing 290 and the lower housing 260 can be press fit together in this illustrated example embodiment. It should be appreciated that these components can be suitably connected in other manners. Additionally, the lower housing 260 includes a cylindrical upper housing engaging shoulder 274. The shoulder 274 is configured to engage or be engaged by and support the bottom portion of the upper housing 290, as best shown in FIG. 4.

The bottom or bottom edge of the radially tapered portion 280 of the lower housing 260 is configured to engage or be engaged by the upper surface of the connecting plate 170, as best shown in FIG. 4. The radially tapered portion 280 includes a central vertically extending inner surface 282 that partially defines an upper portion of the jacking screw channel. Thus, in this illustrated example embodiment, the body of the connecting plate 170 and the radially tapered portion 280 of the lower housing 260 each defines parts of the jacking screw channel. In this illustrated example embodiment, the jacking screw channel is thus a continuous channel extending through the body of the connecting plate 170 and the radially tapered portion 280 of the lower housing 260.

The radially tapered portion 280 includes an intentionally breakable sacrificial inwardly extending flange 291 (sometimes referred to herein as a breakable flange 291) that is connected to and extends inwardly from the inner surface 282 of the radially tapered portion 280. The breakable flange 291 is configured to engage or be engaged by and support the lower surface 212 of the head 206 of the jacking screw 200 when the jacking screw 200 is positioned in the jacking screw channel and the void former 100 is first assembled, embedded, and used. The breakable flange 291 is further configured to break to enable the jacking screw 200 to move downwardly within the jacking screw channel when the jacking screw 200 is rotated. This enables the void former to assist in adjusting the height of the concrete slab, as further described below. In this illustrated example embodiment, the breakable flange 291 extends continuously around the circumference of the inner surface 282 of the radially tapered portion 280. It should be appreciated that in alternative embodiments, the breakable flange 291 may not be continuous (i.e., it can be discontinuous). It should further be appreciated that in alternative embodiments, more than one breakable flange can be connected to and extend from the inner surface 282. It should also be appreciated that the breakable flange may be on the jacking screw in a suitable manner in alternative embodiments.

Figure 11:
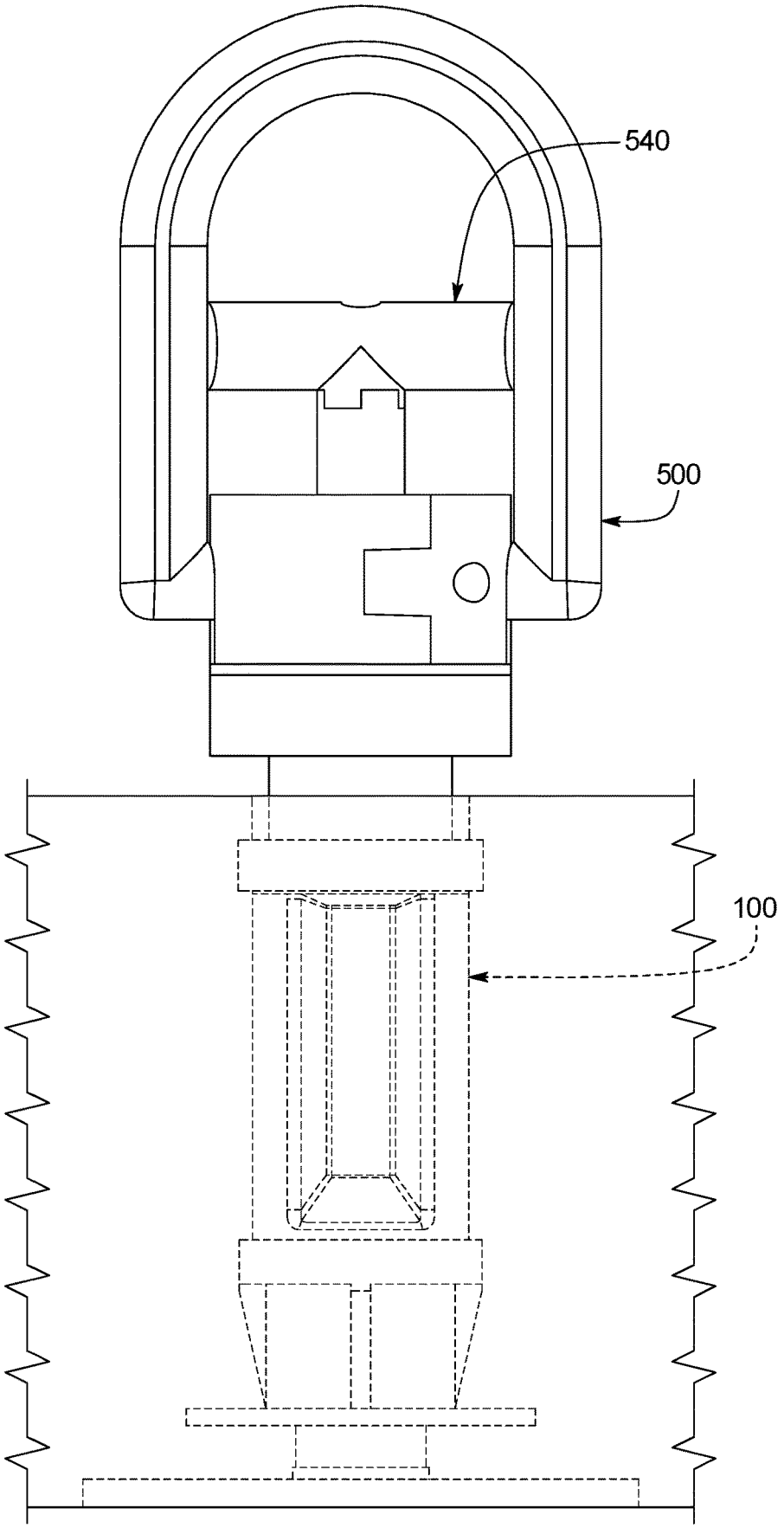
FIG. 11 is a front view showing the lifting bail of FIGS. 1 and 2 inserted into the void former of FIGS. 1 and 2 and in the unlocked position.
Figure 12:
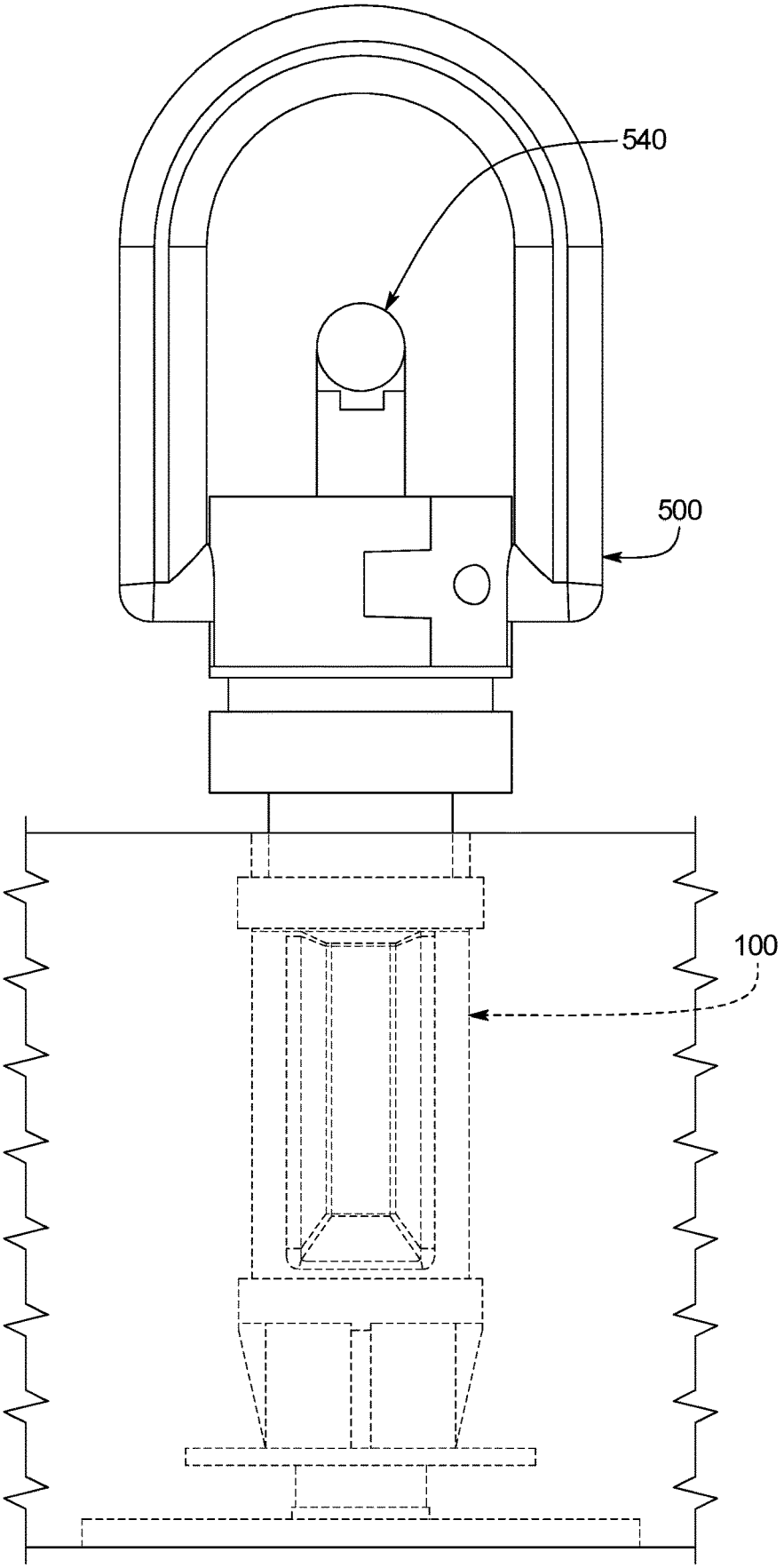
FIG. 12 is a front view showing the lifting bail of FIGS. 1 and 2 inserted into the void former of FIGS. 1 and 2 and in the locked position.

The upper housing 290 of the void former 100 is configured to releasably, securely, and quickly receive the lifting bail 500, as shown in FIGS. 2, 11, and 12 and as further described below. The upper housing 290 of the void former 100 includes a vertically upwardly extending generally cylindrical head 292 and a vertically extending generally cylindrical shaft 294 connected to and extending downwardly from the head 292.

The head 292 of the upper housing 290 includes an inner surface 293 that defines a cap receiving channel, as best shown in FIGS. 4 and 5. The cap receiving channel is configured to receive the removable cap 334, as best shown in FIGS. 4 and 5. In this illustrated example embodiment, the inner surface 293 of the head 292 has a larger inner diameter than the inner diameter of the shaft 294. The upper housing also includes a cylindrical upper lip 295 that is connected to and extends inwardly from the inner surface 293, as best shown in FIGS. 4 and 5. In this illustrated example embodiment, the upper lip 295 is continuous around the circumference of the inner surface 293. It should be appreciated that in alternative embodiments, the upper lip 295 need not be continuous (i.e., it can be discontinuous). The upper lip 295 is configured to engage or be engaged by the removable cap 334 and to assist in securing the removable cap when it is inserted in the cap receiving channel, as further described below. The upper housing 290 and specifically the head 292 and the shaft 294 define a lower shoulder 296 where the head 292 and the shaft 294 meet or are connected, as shown in FIG. 5. The lower shoulder 296 is configured to engage or be engaged by and support the removable cap 334 when the cap 334 is inserted into the upper body 290 of the void former 100.

Figure 3:
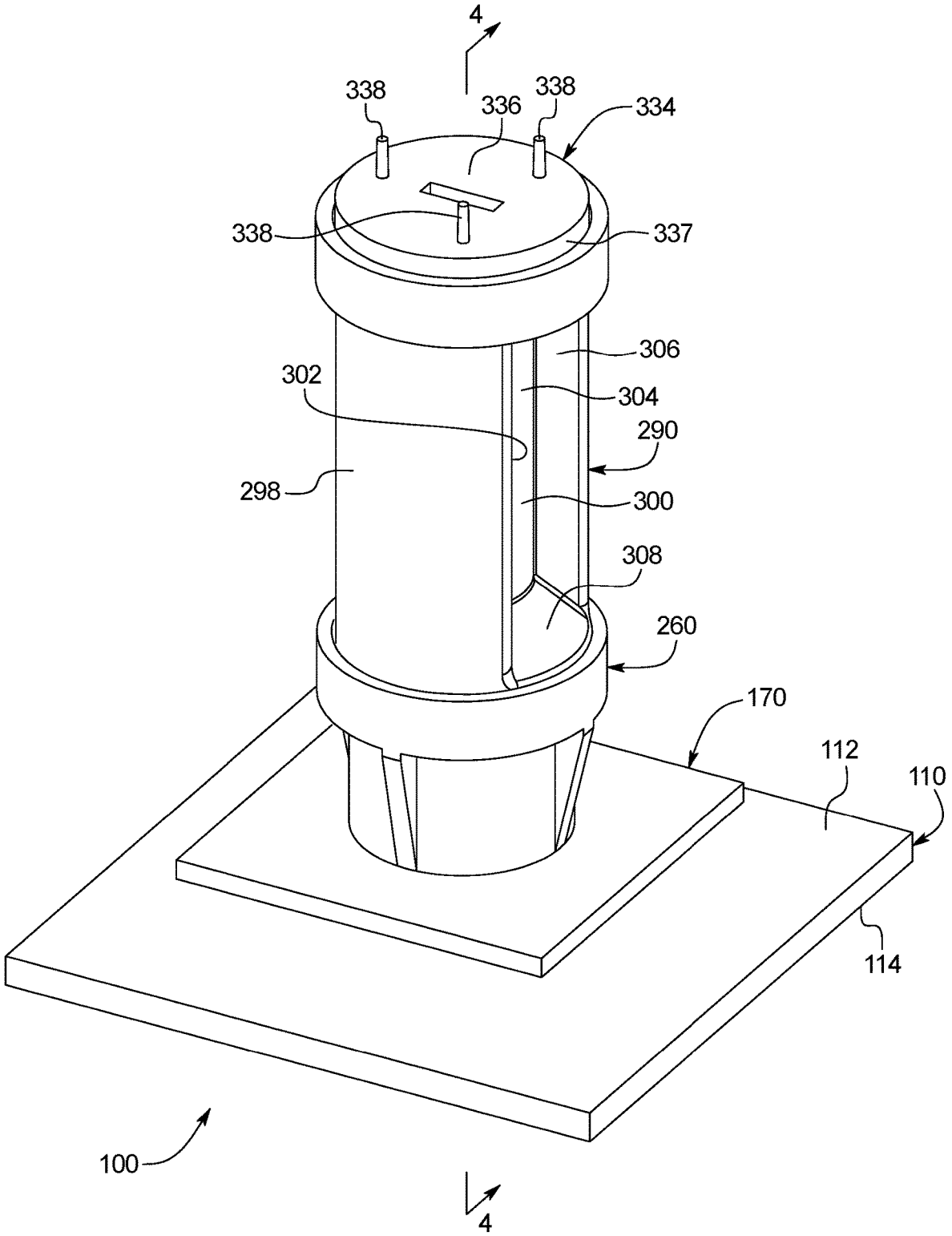
FIG. 3 is an enlarged perspective view of the void former of FIGS. 1 and 2.

The shaft 294 of the upper housing is configured to removably quickly receive the lifting bail 500 of the present disclosure. As shown in FIG. 3, the shaft 294 of the upper housing 290 includes: (1) a first partially cylindrical wall 298; (2) a spaced apart second opposing partially cylindrical wall (not shown); (3) a first indentation defining inwardly extending wall 302; (4) a second indentation defining curved wall 304; (5) a third indentation defining inwardly extending wall 306; (6) a fourth inwardly extending lower inclined indentation defining wall 308; and (7) a fifth inwardly extending upper indentation defining wall 310. The first indentation defining wall 302, the second indentation defining wall 304, the third indentation defining wall 306, the fourth lower inclined indentation defining wall 308, and the fifth upper indentation defining wall 310 collectively define a first indentation 300, as best shown in FIG. 3. Each wall that defines the first indentation 300 has an inner surface and an outer surface.

Additionally, the shaft 294 includes: (1) a first opposing indentation defining inwardly extending wall (not shown); (2) a second opposing indentation defining curved wall (not shown); (3) a third opposing indentation defining inwardly extending wall (not shown); (4) a fourth opposing inwardly extending lower inclined indentation defining wall (not shown); and (5) a fifth opposing inwardly extending upper indentation defining wall (not shown), that collectively define a second indentation (not shown). The second indentation is on the opposite side of the shaft 294 from the first indentation. Each wall that defines the second indentation has an inner surface and an outer surface.

More specifically, as shown in FIGS. 4, 5, 14, and 15, the inner surfaces of the first indentation defining wall 302, the second indentation defining wall 304, the third indentation defining wall 306, the fourth lower inclined indentation defining wall 308, and the fifth upper indentation defining wall 319 collectively define a first lifting bail guide 312. The first lifting bail guide 312 includes a first trapezoidal vertically extending stopping wall 316 and an opposing second vertically extending stopping wall 320. The first stopping wall 316 of the first lifting bail guide 312 includes an inner surface and an outer surface (each not labeled). The second stopping wall 320 of the first lifting bail guide 312 includes an inner surface and an outer surface (each not shown). The inner surface of the first stopping wall 316 of the first lifting bail guide 312, the inner surface 318 of the fourth lower inclined indentation defining wall 308 of the first indentation 300, and the inner surface of the second stopping wall 320 of the first lifting bail guide 312 define a first locking lip chamber 314. The first locking lip chamber 314 is configured to receive a first locking lip of the lifting bail 500, as further described below.

Likewise, the inner surfaces of the first opposing indentation defining wall, the second opposing indentation defining wall, the third opposing indentation defining wall, the fourth opposing lower inclined indentation defining wall, and the fifth opposing upper indentation defining wall that collectively define the second indentation also define an opposing second lifting bail guide (not shown).

Likewise, the second lifting bail guide (not shown) includes a first trapezoidal vertically extending stopping wall (not shown) and an opposing second trapezoidal vertically extending stopping wall (not shown). The first stopping wall of the second lifting bail guide includes an inner surface and an outer surface (each not shown). The second stopping wall of the second lifting bail guide includes an inner surface and an outer surface (each not shown). The inner surface of the first stopping wall of the second lifting bail guide, the inner surface of the fourth lower inclined indentation defining wall of the second indentation, and the inner surface of the second stopping wall of the second lifting bail guide define a second locking lip chamber (not shown). The second locking lip chamber is configured to receive a second locking lip of the lifting bail 500, as further described below.

Figure 6:
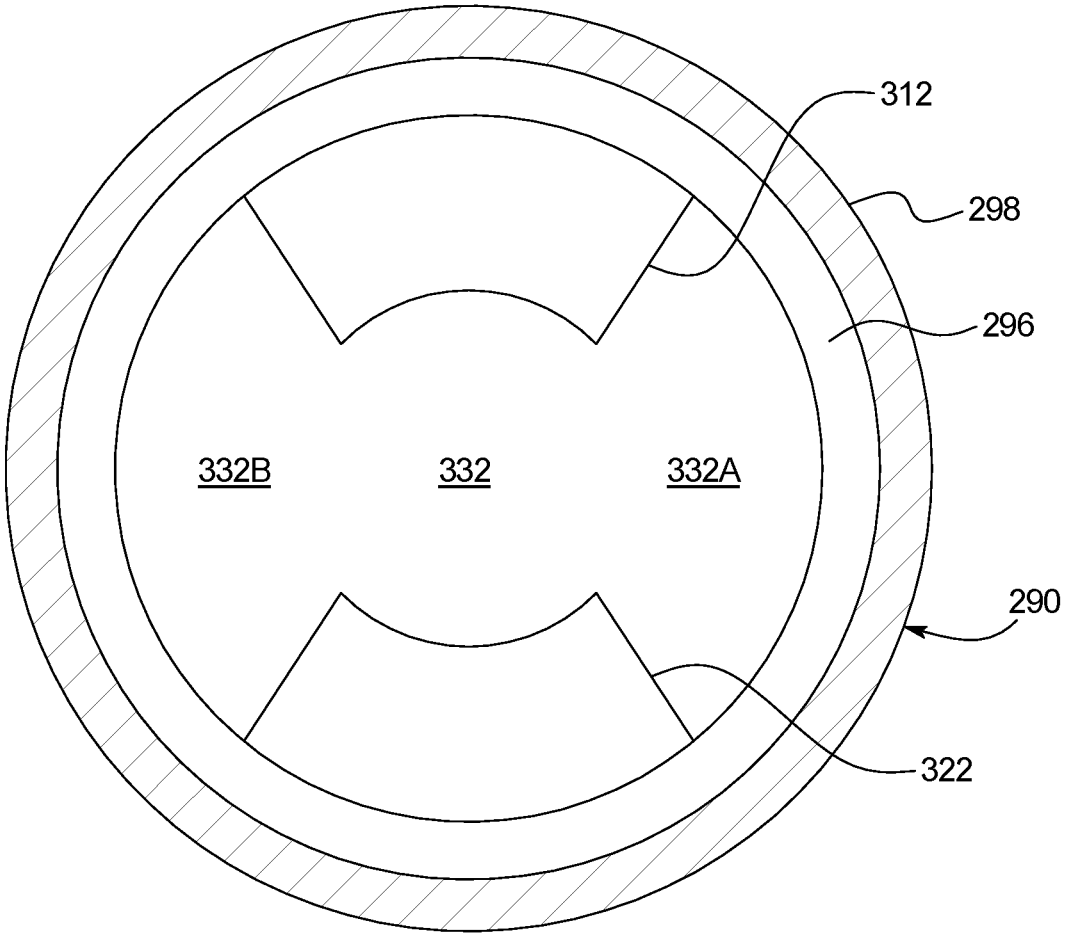
FIG. 6 is cross-sectional view taken substantially along line 6-6 of FIG. 5, showing a lifting bail receiving channel of the void former.

As described above, the shaft 294 is configured to receive the lifting bail guide 500 of the present disclosure. More specifically, the inner surfaces of the first partially cylindrical wall 298, the second partially cylindrical wall, each wall that defines the first indentation 300, and each wall that defines the second indentation defines a bow-tie shaped lifting bail receiving channel 332, as best shown in FIG. 6. A portion of the lifting bail receiving channel 332 is defined as a first guided channel 332A and an opposing portion is defined as a second guided channel 332B. The shape of the lifting bail receiving channel 332, (including the first guided channel 332A and second guided channel 332B) corresponds to the shape of a main stem 690 and a locking pin 720 of the lifting bail 500, as further described below.

The removable cap 334 is configured to be inserted and removed from the cap receiving channel of the head 292 of the upper housing 290. For example, the removable cap 334 can be inserted into the cap receiving channel when the void former 100 is positioned to be embedded in a concrete slab that will be poured so that concrete does not enter into the cap receiving channel and the bow-tie shaped lifting bail receiving channel 332 of the void former 100. The removable cap 334 includes a body. The shape of the body of the removable cap 334 corresponds to the shape of the cap receiving channel. The body includes a cylindrical upper wall 336 and defines an inwardly extending slot that extends downwardly from the upper surface of the wall 336. The slot is configured to receive an object such as a screw driver so that the screw driver can be used to remove the removable cap 334 from the void former 100. The body further includes a vertically extending cylindrical wall 337 that extends downwardly from the wall 336. The wall 337 defines an upper lip receiving indentation 339 (as shown in FIG. 5) that is configured to receive in locking engagement the upper lip 295 of the head 292 of the upper housing 290. Thus, when the upper lip 295 extends into the upper lip receiving indentation 339, the removable cap 334 is removably secured in the cap receiving channel. In this illustrated example embodiment, the upper lip receiving indentation 339 is continuous around the circumference of the outer surface 337. It should be appreciated that in alternative embodiments, the upper lip receiving indication 339 need not be continuous around the circumference of the outer surface 337 (i.e., it can be discontinuous).

The removable cap 334 further includes a plurality of bendable antennas 338. The antennas 338 are connected to and extend from the upper surface 336 of the removable cap 334. The antennas 338 are configured to serve as location indicators. More specifically, when the void former 100 having the removable cap 334 is embedded in a newly poured concrete slab, the newly poured concrete can potentially rise above the upper surface of the wall 336 of the removable cap 334. Thus, the newly poured concrete can cover and hide the void former 100 from one's sight. Each bendable antenna 338 is of a suitable height so that each can extend out from the newly poured concrete if the concrete rises above the upper surface of the wall 336 of the removable cap 334. Thus, when seeing the bendable antennas 338, a user will know where to remove excess concrete so that the removable cap 334 can be accessed and can be properly removed from the void former 100 before inserting the lifting bail 500.

In various embodiments, the jacking plate, the connecting plate, and the bottom fastener are each made of galvanized steel. In various embodiments, the jacking screw is made of a suitable metal. In various embodiments, the lower body and the upper body are each made of a plastic, such as ABS plastic. In various embodiments, the removable cap and the seal plate are each made of a plastic, such as polyethylene. It should be appreciated that one or more of these components can be made from alternative materials and in alternative configurations.

LIFTING BAIL

Figure 7:
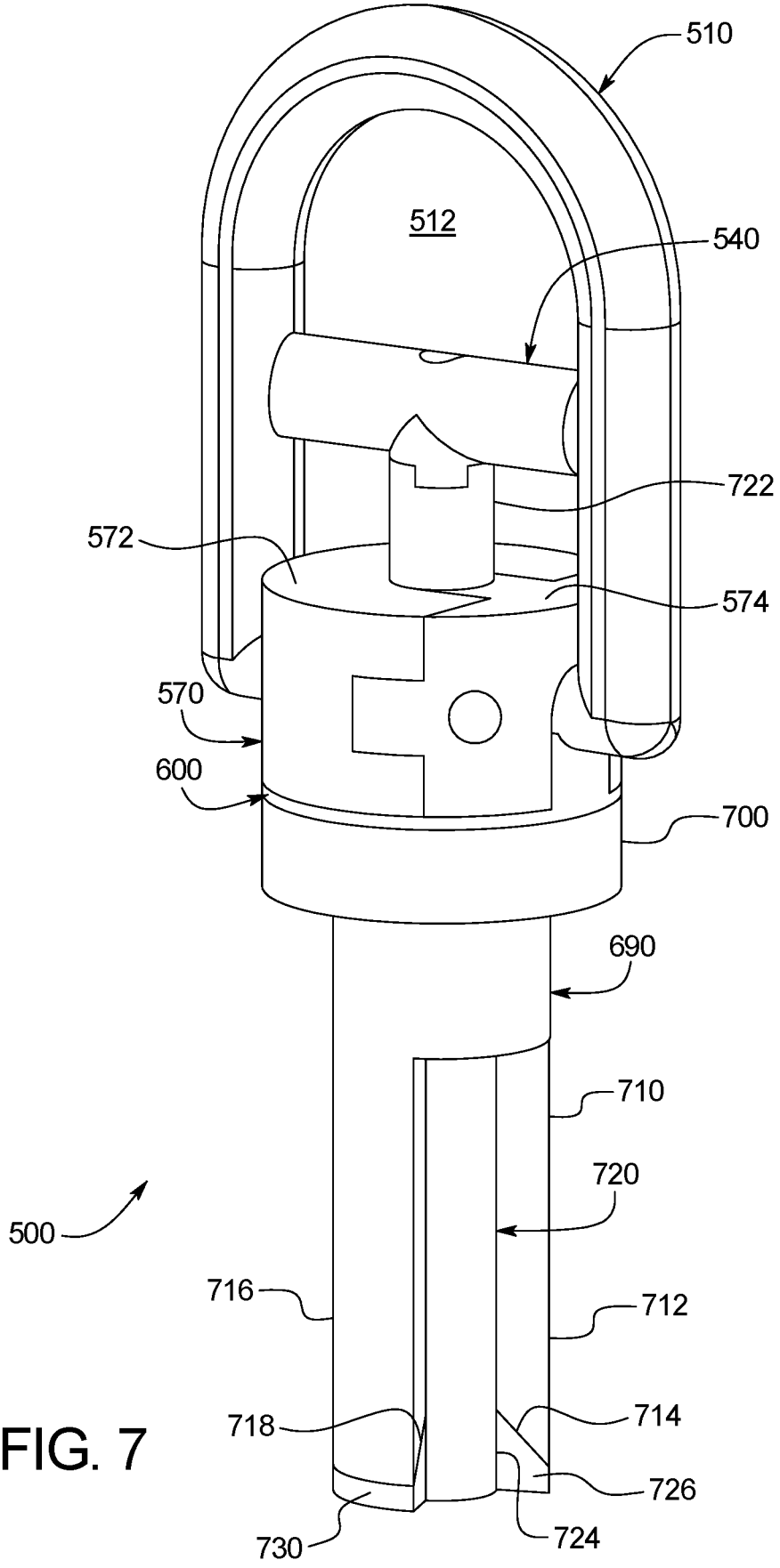
FIG. 7 is an enlarged perspective view of the lifting bail of FIGS. 1 and 2 in an unlocked position.
Figure 8:
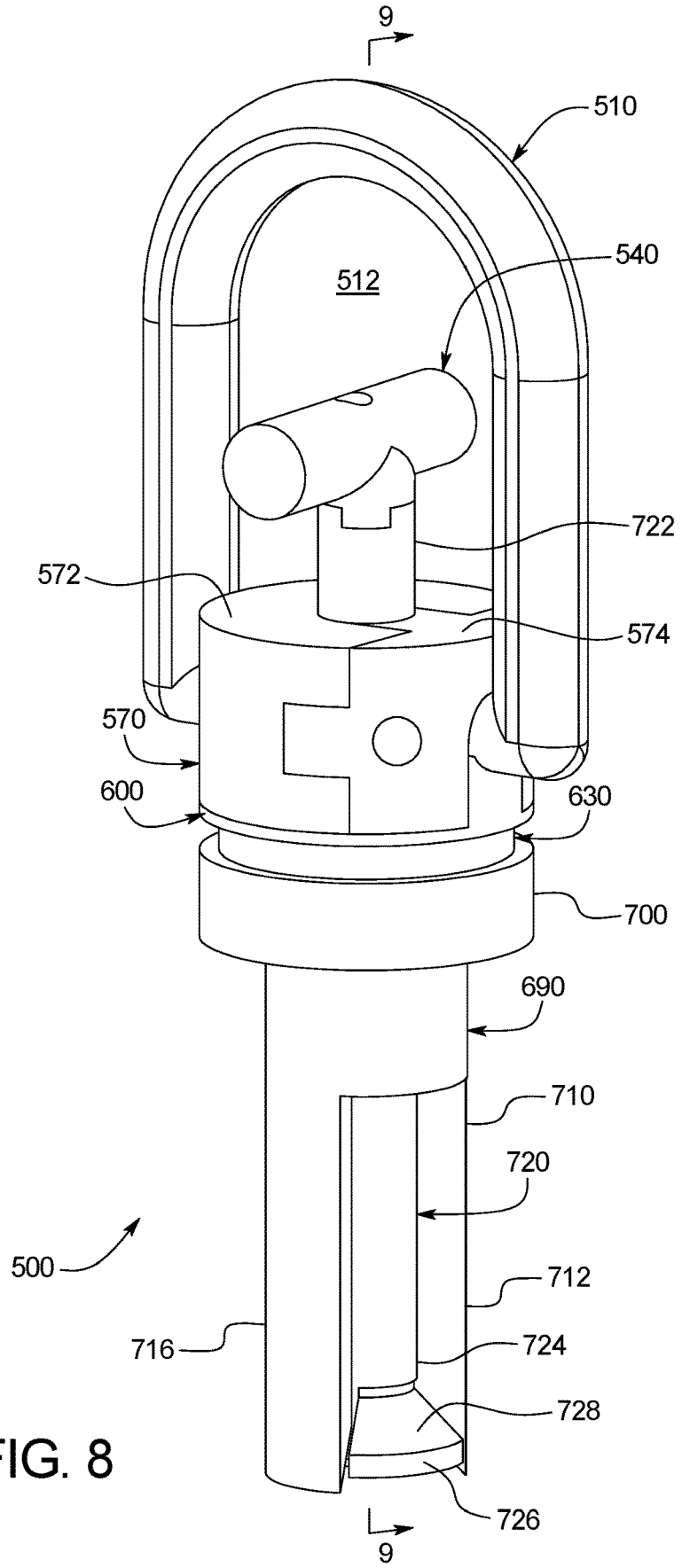
FIG. 8 is an enlarged perspective view of the lifting bail of FIGS. 1 and 2 in a locked position.

Referring now to FIGS. 7, 8, 9, and 10, the lifting bail 500 of one illustrated example embodiment of the present disclosure is shown and described below. Generally, the lifting bail 500 of this illustrated example embodiment includes: (1) a main stem 690; (2) a central rotatable locking pin 720; (3) a biasing member 660; (4) a locking indicator 630; (5) a handle retention cap 600; (6) an encaser 570; (7) a locking pin handle 540; and (8) a lifting handle 510. The lifting bail 500 can be positioned in a locked position (as shown in FIG. 7) or an unlocked position (as shown in FIG. 8). For brevity, the central rotatable locking pin may be referred to herein as the locking pin.

Figure 9:
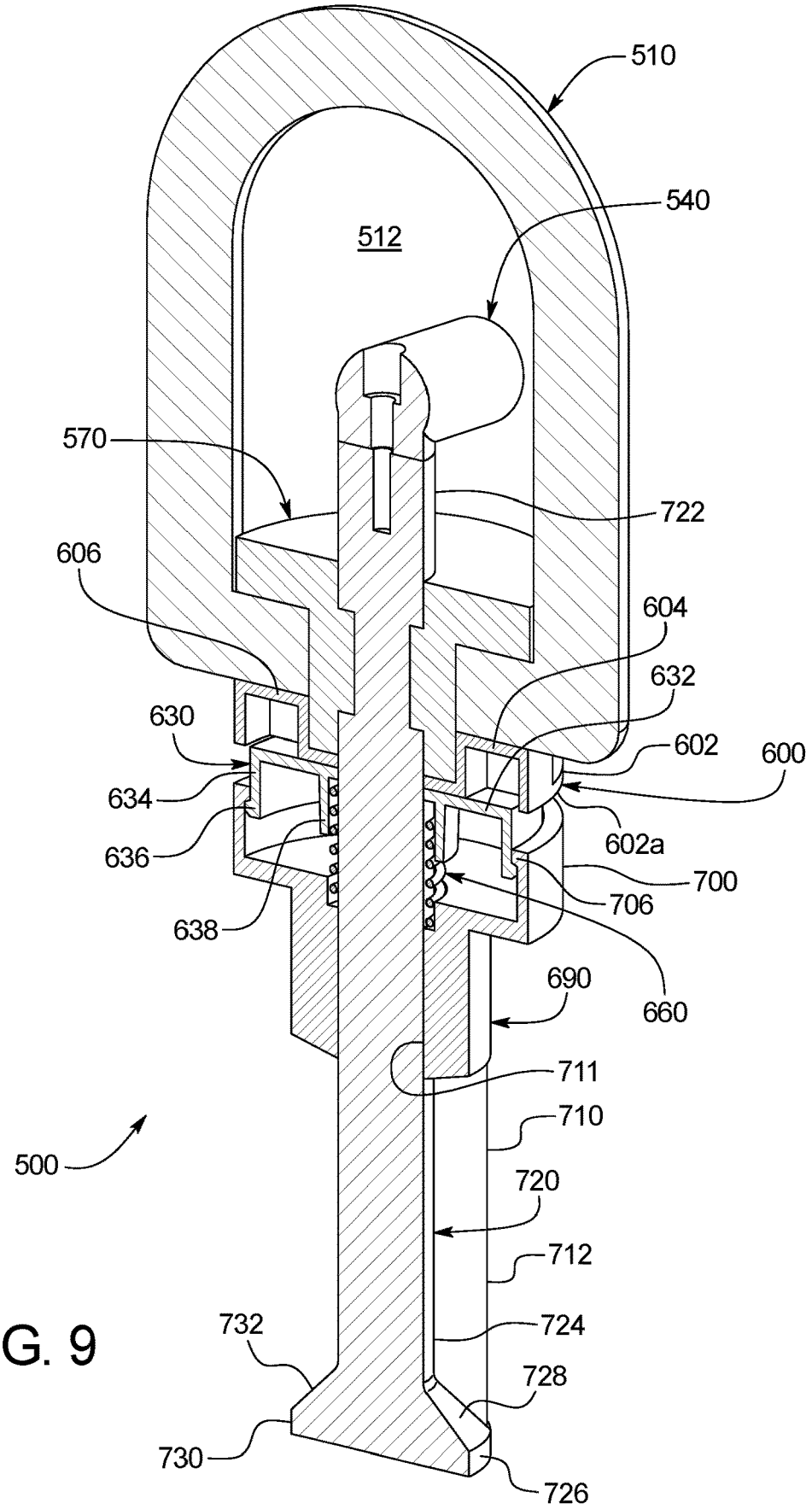
FIG. 9 is a cross-sectional perspective view of the lifting bail of FIGS. 1 and 2 taken substantially along line 9-9 of FIG. 8.
Figure 14:
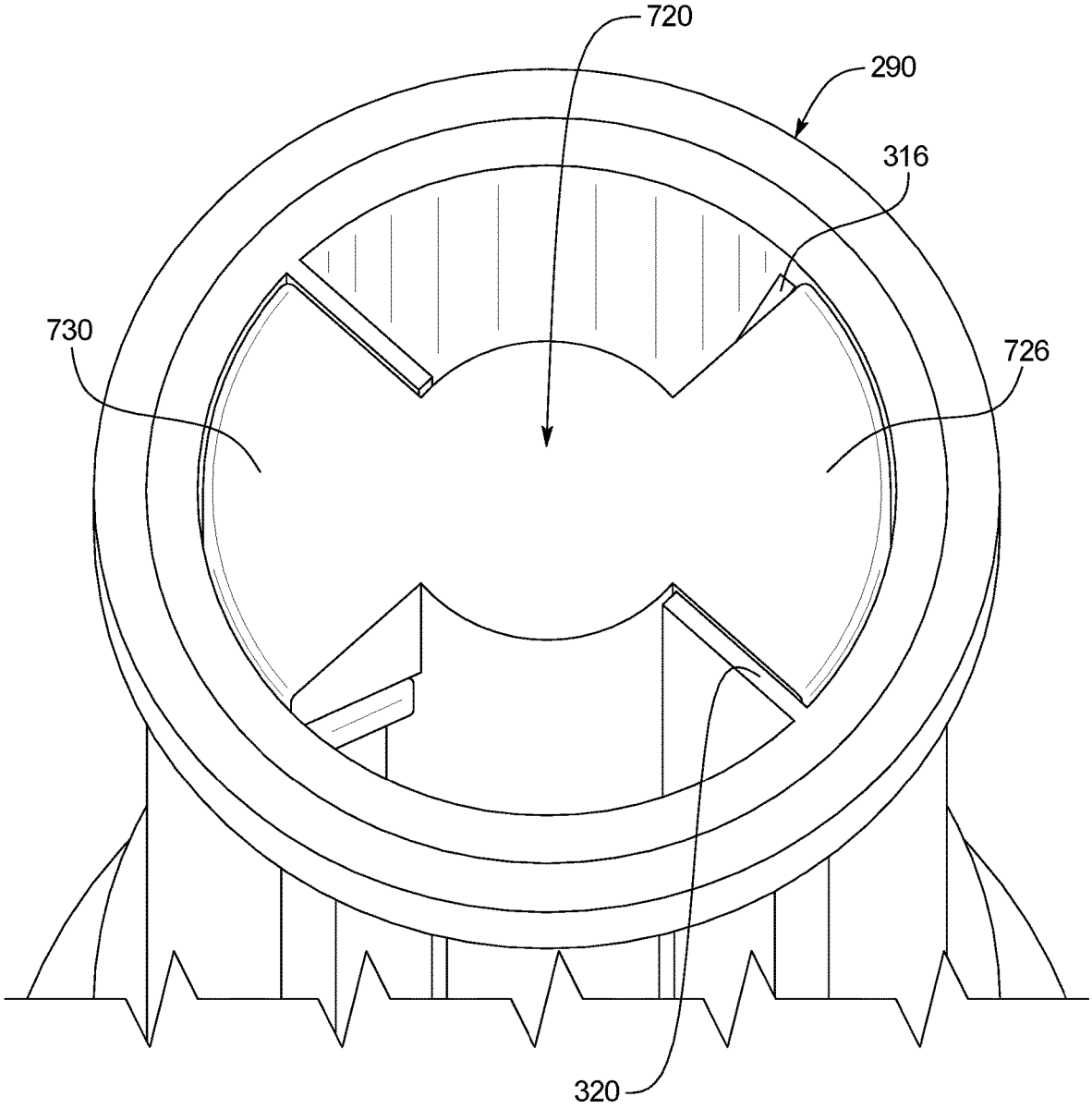
FIG. 14 is a bottom view showing the lifting bail of FIGS. 1 and 2 inserted into and in the unlocked position in the void former of FIGS. 1 and 2.
Figure 15:
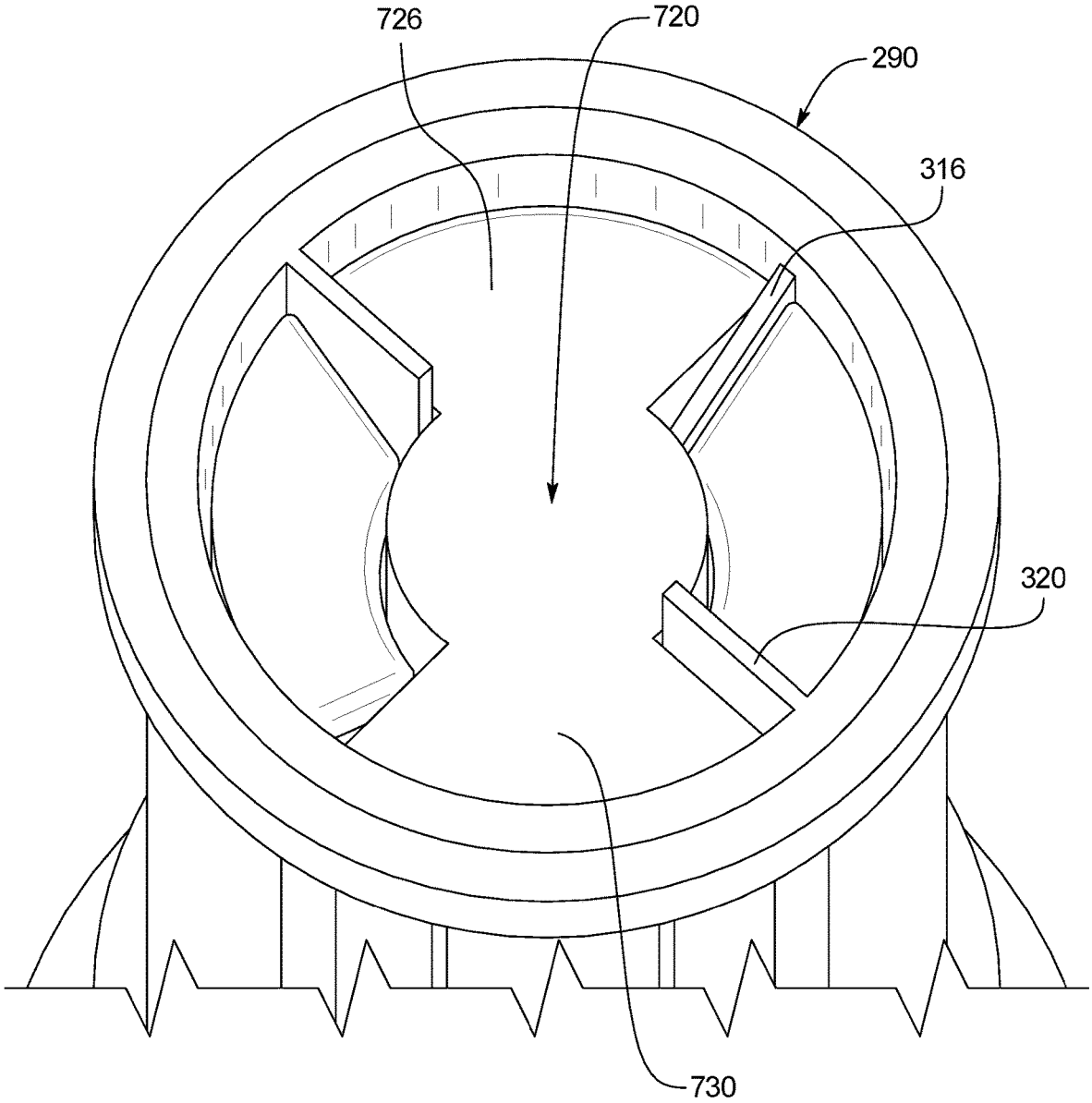
FIG. 15 is a bottom view showing the lifting bail of FIGS. 1 and 2 inserted into and in the locked position in the void former of FIGS. 1 and 2.

The lower portion of the main stem 690 of the lifting bail 500 is generally bow-tie shaped and configured to be inserted into the upper housing 290 of the void former 100. The main stem 690 includes a generally upwardly extending cylindrical head 700 and a bow-tie shaped vertically extending elongated shaft 710 extending downwardly from the head 700. The cylindrical head 700 and bow-tie shaped shaft 710 are integrally connected in this illustrated example embodiment. The main stem 690 includes an inner vertically extending cylindrical inner wall 711 that partially defines a vertically extending central cylindrical locking pin channel, as shown in FIG. 9. The locking pin channel is configured to enable the locking pin 720 to rotate from the unlocked position (as shown in FIGS. 7 and 14) to the locked position (as shown in FIGS. 8 and 15) and vice versa. As further described below, the vertically extending locking pin channel is also partially defined by other components of the lifting bail 500.

Figure 10:
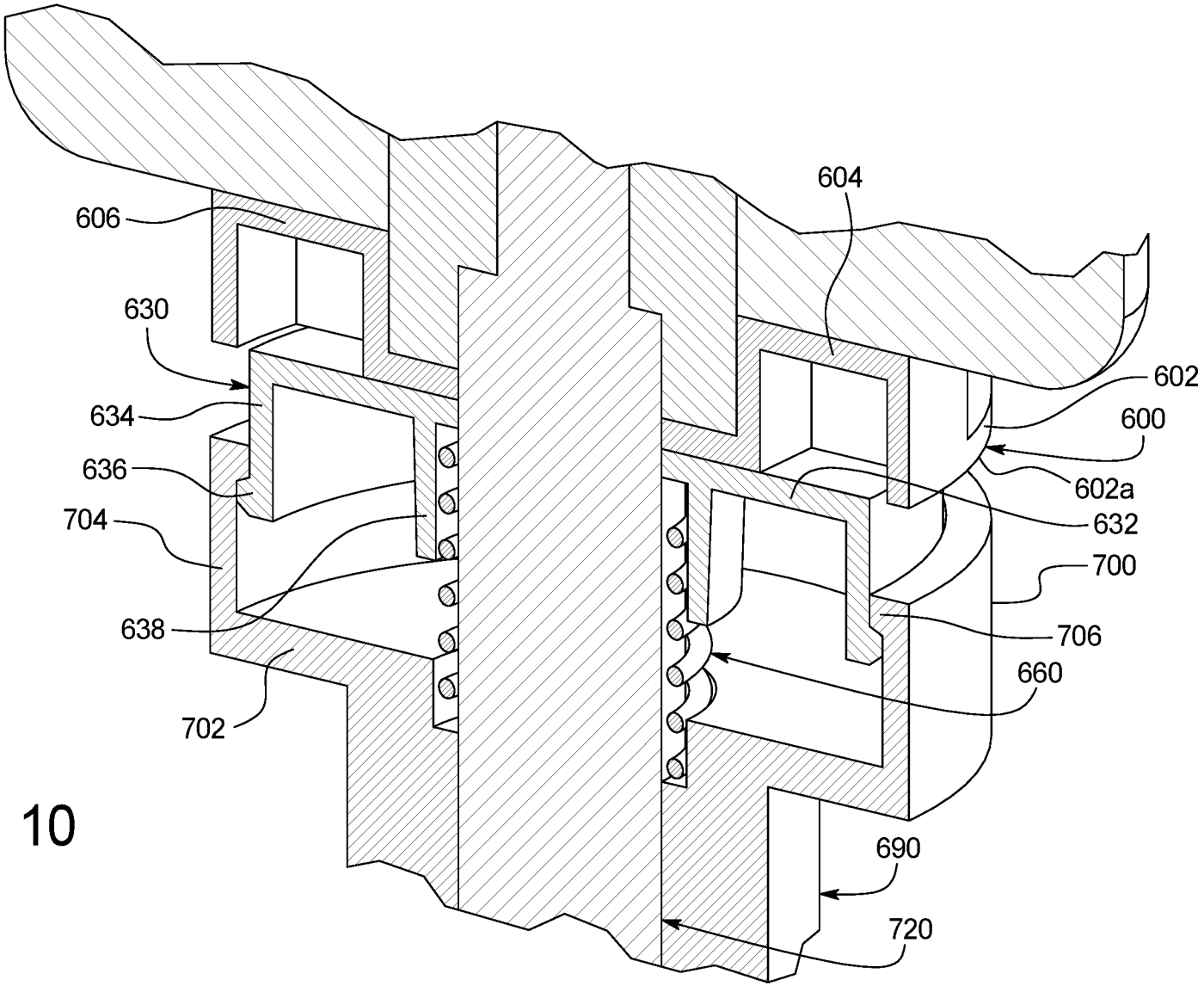
FIG. 10 is an enlarged fragmentary cross-sectional perspective view of part of the lifting bail of FIGS. 1 and 2.

More specifically, the head 700 of the main stem 690 includes a cylindrical horizontally extending planar wall 702 and a vertically extending wall 704 that extends upwardly from the wall 702, as best shown in FIG. 10. The inner surfaces of the wall 702 and the wall 704 define a housing chamber configured to at least partially receive the locking indicator 630 and the biasing member 660.

The head 700 further includes a cylindrical inwardly extending stopping lip 706 that includes an inclined stopping surface (not labeled), as best shown in FIGS. 9 and 10. The inclined stopping surface of the stopping lip 706 is configured to engage or be engaged by the locking indicator 630 to limit the upward movement of the locking indicator 630, as further described below. In this illustrated example embodiment, the stopping lip 706, and therefore the stopping lip surface, extends continuously around the body of the head 700 of the main stem 690.

The bow-tie shaped shaft 710 (which is configured to be inserted in the void former 100, as mentioned above and further described below) includes an upper portion (not labeled) that also partially defines the locking pin channel. The bow-tie shaped shaft 710 includes a first elongated annular column 712 and a spaced apart second elongated annular column 716, as best shown in FIGS. 7 and 8. An inner surface of the first annular column 712 is configured to be adjacent to or engage a portion of the locking pin 720. The first annular column 712 includes an inwardly inclined bottom surface 714. The bottom surface 714 corresponds to the shape of a first locking lip 726 of the locking pin 720, as further described below. Likewise, an inner surface of the second annular column 716 is configured to be adjacent to or engage a portion of the rotatable locking pin 720. The second annular column 716 includes an inwardly inclined bottom surface 718. The bottom surface 718 corresponds to the shape of a second locking lip 730 of the locking pin 720, as further described below.

The locking pin 720 is configured to be rotatable within the locking pin channel from the unlocked position (see FIGS. 7 and 14) to the locked position (see FIGS. 8 and 15) and vice versa. In this illustrated example embodiment, the locking pin 720 is rotatable approximately ninety degrees. It should be appreciated that the locking pin 720 can be rotatable more or less than ninety degrees in alternative embodiments of the present disclosure.

The locking pin 720 includes an upper end 722 and a lower end 724. The locking pin handle 540 is connected to the upper end 722 by a suitable fastener (not shown). The locking pin 720 is configured to extend vertically through the locking pin channel. The locking pin 720 is configured to be adjacent to or engage the inner surface of the first annular column 712 of the main stem 690 and the inner surface of the second annular column 716 of the main stem 690.

The lower end 724 of the locking pin 720 includes a radially extending first locking lip 726. The first locking lip 726 has an inwardly inclined upper surface 728. This upper surface 728 has a shape that generally corresponds to the shape of the bottom surface 714 of the first annular column 712 of the main stem 690, as best shown in FIGS. 7 and 9. Likewise, the lower end 724 of the locking pin 720 also includes a radially extending second locking lip 730. The second locking lip 730 has an inwardly inclined upper surface 732. This upper surface 732 has a shape that generally corresponds to the shape of the bottom surface 718 of the second annular column 716 of the main stem 690, as best shown in FIG. 7. The first locking lip 726 and the second locking lip 730 are each configured to enable the locking pin 720 to rotate, as further described below. The first locking lip 726 and the second locking lip 730 are integrally connected to the locking pin 720 in this illustrated example embodiment.

The biasing member 660 is configured to bias the locking pin 720, the locking indicator 630, the handle retention cap 600, the encaser 570, and the locking pin handle 540 upwardly. More specifically, the biasing member 660 includes an upper portion (not labeled) that engages and applies an upward biasing force against a bottom surface of the locking indicator 630.

In this illustrated example embodiment, the biasing member 660 is in the housing chamber of the head 700 of the main stem 690. More specifically, the biasing member 660 is journaled around the locking pin 720, as best shown in FIGS. 9 and 10. The biasing member 660 partially engages the locking indicator 630 and the main stem 690. The biasing member also partially defines the locking pin channel.

The locking indicator 630 is configured to move upwardly to a visible position (as shown in FIGS. 9 and 10) to indicate to a user that the lifting bail 500 is in the locked position. The locking indicator 630 is partially positioned in the housing chamber of the main stem 690. In this example embodiment, the locking indicator 630 is green. In alternative embodiments, the locking indicator 630 can be another suitable color that can visibly indicate whether the lifting bail 500 is positioned in a locked or unlocked position.

More specifically, as shown in FIGS. 9 and 10, the locking indicator 630 includes a generally horizontally extending upper wall 632 that has an upper surface and a lower surface (each not labeled). The locking indicator 630 further includes a downwardly extending generally cylindrical main stem engager wall 634 that is integrally connected and extends downwardly from the inner surface of the upper portion 632. The main stem engager wall 634 includes an outwardly extending cylindrical stopping lip 636. The stopping lip 636 includes an inclined stopping lip surface that is configured to engage the inclined surface of the stopping lip 706 of the head 700 of the main stem 690, as best shown in FIG. 10. Thus, when the locking indicator 630 moves upwardly, the surface of the stopping lip 636 of the locking indicator 630 engages the surface of the stopping lip 706 of the head 700 of the main stem 690 to cause the locking indicator 630 to stop moving upwardly. In this illustrated example embodiment, the stopping lip 636 extends continuously around the main stem engager wall 634 of the locking indicator 630. It should be appreciated that in alternative embodiments, the stopping lip 636 need not be continuous around (i.e., it can be discontinuous).

The locking indicator 630 further includes a smaller generally cylindrical central wall 638 extending downwardly from the lower surface of the upper portion 632 of the locking indicator 630. This wall 638 includes an inner surface that partially defines the locking pin channel, as best shown in FIGS. 9 and 10. This portion of the locking pin channel also partially receives the biasing member 660. Thus, the inner surface of the wall 638 is adjacent to or engages a portion of the biasing member 660.

The handle retention cap 600 is configured to at least partially cover the locking indicator 630, at least partially support the lifting handle 510, and cover a bottom portion of the encaser 570. The handle retention cap 600 includes a generally cylindrical vertically extending outer wall 602 having a lower surface **602*a*, as shown in FIGS. 9 and 10. The lower surface 602*a* is configured to engage or be engaged by an upper surface of the main stem 690 when the lifting bail 500 is in the unlocked position, as best shown in FIG. 7**.

As shown in FIGS. 9 and 10, the handle retention cap 600 further includes a first horizontally extending lifting handle engaging wall 604 and a second opposing horizontally extending lifting handle engager wall 606. The first wall 604 has a concave upper surface that is configured to engage a portion of the lifting handle 510, as further described below. The second wall 606 has a concave upper surface that is configured to engage a different portion of the lifting handle 510, as further described below. Additionally, an inner surface of a horizontally extending cylindrical wall of the body of the handle retention cap 600 (not labeled) partially defines the locking pin channel.

In this illustrated example embodiment, the handle retention cap 600 is positioned underneath part of the encaser 570. Thus, when the handle retention cap 600 moves upwardly, the encaser 570 also moves upwardly. Conversely, when the handle retention cap 600 moves downwardly, the encaser 570 also moves downwardly. Additionally, when the encaser 570 rotates, the handle retention cap 600 rotates with the rotation of the encaser 570.

The encaser 570 of the lifting bail 500 is configured to be rotatable about the locking pin 720. The encaser 570 is also configured to be moveable upwardly (and thereafter downwardly) along a length of the locking pin 720, as further described below. The encaser 570 of the lifting bail 500 has a generally cylindrical shape. The encaser 570 includes a connectable first half 572 and a connectable second half 574. In this illustrated example embodiment, the first half 572 and the second half 574 of the encaser 570 are removably connected. It should be appreciated that the encaser 570 can be made of one or more connectable portions in alternative embodiments. It should further be appreciated that in other alternative embodiments, the encaser 570 can be made of integrally connected portions.

The encaser 570 defines a first upside down horseshoe shaped notch (not labeled). In this illustrated example embodiment, a portion of the lifting handle 510 extends substantially horizontally through the first notch of the encaser 570, as further described below. The encaser 570 also defines a second opposing upside down horseshoe shaped notch (not labeled). In this illustrated example embodiment, a different portion of the lifting handle 510 extends substantially horizontally through the second notch of the encaser 570, as further described below.

The encaser 570 further includes a first pivot point and a second pivot point (each not shown). Each pivot point connects to an opposing portion of the lifting handle 510. Each pivot point is configured to enable the lifting handle 510 to be pivotable relative to the encaser 570. Each pivot point is also configured to enable the lifting handle 510 to be rotatable with the rotation of the encaser 570.

The encaser 570 further includes an inner vertically extending cylindrical wall (not shown) that partially defines the locking pin channel. Thus, in this illustrated example embodiment, the locking pin channel continuously extends vertically through the encaser 570, the handle retention cap 600, the locking indicator 630, the biasing member 660, and the main stem 690.

The locking pin handle 540 of the lifting bail 500 is configured to rotate to cause the locking pin 720 to rotate from the unlocked to the locked position and vice versa. The locking pin handle 540 is connected to the upper end 722 of the locking pin 720, as mentioned above.

The lifting handle 510 of lifting bail 500 is configured to enable an object (such as the hook 50 attached to a lifting machine 60 as shown in FIG. 1) to lift the lifting bail 500, the void former 100 that the lifting bail 500 is attached to, and the concrete slab 10 that the void former 100 is embedded in. The lifting handle 510 includes a generally upside down U-shaped portion (not labeled), a first horizontally extending portion (not labeled), and a second opposing horizontally extending portion (not labeled). The first horizontally extending portion and the second horizontally extending portion are each integrally connected to opposing portions of the U-shaped portion of the lifting handle 510. The first horizontally extending portion extends into the first notch of the encaser 570 and pivotally connects to the first pivot point of the encaser 570. The second horizontally extending portion extends into the second notch of the encaser 570 and pivotally connects to the second pivot point of the encaser 570.

The lifting handle 510 is configured to pivot at most approximately 180 degrees relative to the encaser 570. The lifting handle 510 is configured to rotate with the rotation of the encaser 570. The body of the lifting handle 510 defines an opening 512, which enables an object such as the hook 50 in FIG. 1 to be attached to the lifting handle 510.

In various embodiments, the lifting handle, the locking pin handle, the encaser, the biasing member, the main stem, and the locking pin are each made of a suitable metal. In various embodiments, the handle retention cap and the locking indicator are each made of a suitable plastic material. It should be appreciated that one or more of these components can be made from alternative materials and in alternative configurations.

CO-ACTION OF VOID FORMER AND LIFTING BAIL

Referring now to FIGS. 6, 7, 8, 9, 10, 11, 12, 13, 14, and 15, how the lifting bail co-acts with the void former will now be discussed. As described above, the lifting bail 500 can be in the unlocked position (see FIGS. 7 and 14) or the locked position (see FIGS. 8 and 15). When in the unlocked position, the lifting bail 500 can be quickly inserted into the void former 100. The lifting bail 500 can further be quickly locked or secured in the void former 100 by rotating the locking pin handle 540. The lifting bail 500 can further be quickly unlocked and thereafter quickly removed from the void former 100.

More specifically, prior to insertion of the lifting bail 500 into the void former 100, the lifting bail 500 is in the unlocked position. In the unlocked position, the first locking lip 726 is generally aligned with and beneath the first annular column 712 of the main stem 690, such that the upper surface 728 of the first locking lip 726 is adjacent to or engages the lower surface 714 of the first annular column 712, as shown in FIG. 7. Additionally, the second locking lip 730 is generally aligned with and beneath the second annular column 716 of the main stem 690, such that the upper surface 732 of the second locking lip 730 is adjacent to or engages the lower surface 718 of the second annular column 716, as shown in FIG. 7. The locking indicator 630 is positioned in the housing chamber of the main stem 690. Thus, the locking indicator 630 is not visible when the lifting bail 500 is in the unlocked position. Additionally, when the lifting bail 500 is in the unlocked position, the biasing member 660 is at least partially compressed. The biasing member 660 will be further described below when describing the lifting bail 500 in the locked position.

To insert the lifting bail 500 in the void former 100, the main stem 690 and the locking pin 720 are inserted into the bow-tie shaped lifting bail receiving channel 332. More specifically, the first annular column 712 and the first locking lip 726 each travel through the first guided channel 332A between the first locking bail guide 312 and the second locking bail guide 322, as best shown in FIG. 6. The shape of the first guided channel 332A corresponds to the shape of the first annular column 712 and the first locking lip 726. Additionally, the second annular column 716 and the second locking lip 730 each travel through the opposing second guided channel 332B between the first locking bail guide 312 and the second locking bail guide 322, as best shown in FIG. 6. The shape of the opposing second guided channel 332B corresponds to the shape of the second annular column 716 and the second locking lip 730. The lifting bail 500 is positioned in the lifting bail receiving channel 332 so that the first locking lip 724 is positioned beneath the first locking lip chamber 314. In other words, the upper surface 728 of the first locking lip 724 is positioned beneath the first and second vertically extending stopping walls 316 and 320 of the first lifting bail guide 312. Additionally, the second locking lip 730 is positioned beneath the second locking lip chamber. In other words, the upper surface 732 of the second locking lip 730 is positioned beneath the first and second vertically extending walls of the second lifting bail guide 322.

After the lifting bail 500 is positioned in the lifting bail receiving channel 332, the locking pin handle 540 of the lifting bail 500 can be rotated to cause the lifting bail 500 to be in the locked position, as shown in FIG. 12. More specifically, the locking pin handle 540 is rotated ninety degrees. This causes the locking pin 720, and therefore the first locking lip 726 and the second locking lip 730, to rotate ninety degrees (as shown in FIGS. 7,8, 14, and 15). The first locking lip 726 rotates ninety degrees to be positioned in the first locking lip chamber 314. The second locking lip 730 rotates ninety degrees to be positioned in the second locking lip chamber.

When the locking lips 726 and 730 are rotated and positioned in each one's respective locking lip chamber, the biasing member 660 can decompress. Consequently, the biasing member 660 biases the locking pin 720, the locking indicator 630, the handle retention cap 600, the encaser 570, and the locking pin handle 540 upwardly. The upwardly movement of the encaser 570 also causes the locking pin 720, and therefore the first and second locking lips 726 and 730 to move upwardly. More specifically, the biasing member 660 pushes upwardly on the locking indicator 630, which pushes upwardly on the handle retention cap 600, which pushes upwardly on the encaser 630. Thus, the locking indicator 630, the handle retention cap 600, and the encaser 570 of the lifting bail 500 move upwardly. This causes the locking indicator 630 to become visible. When the locking indicator 630 is visible, the locking bail 500 that is positioned in the void former 100 is indicated to be in the locked position. The upwardly movement of the locking indicator 630, the handle retention cap 600 and the encaser 570 is thereafter halted because the stopping lip surface of the stopping lip 636 of the locking indicator 630 engaging the stopping lip surface of the stopping lip 706 of the head 700 of the main stem 690.

Additionally, as the biasing member 660 decompresses, the upwardly movement of the encaser 570 causes the locking pin 720, and therefore the first locking lip 726 and the second locking lip 730, to move slightly upwardly in the lifting bail receiving channel 332 (as shown in FIG. 15). At this point, the lifting bail 500 is in the locked position while in the void former 100.

The upwardly movement of these members of the lifting bail 500 is thereafter stopped because the upper surface 728 of the first locking lip 726 engages the inner surface 318 of the fourth lower inclined indentation defining wall 308 that defines the first locking lip chamber 314. Additionally, the upper surface 732 of the second locking lip 730 engages the inner surface of the fourth lower inclined indentation defining wall of the second indentation that defines the second locking lip chamber. Each of these engagements causes the lifting bail 500 to be in the locked position (as shown in FIG. 15). Thus, if the locking pin handle is further rotated or lifted, the first locking lip 726 will not be able to rotate or move out from the first locking lip chamber 314. Additionally, the second locking lip 730 will not be able to rotate or move out from the second locking lip chamber. Therefore, the lifting bail 500 cannot be removed from the void former 500 while in the locked position.

To put the lifting bail 500 back in the unlocked position, the locking pin handle 540 is pushed downwardly and then rotated. This causes the locking pin 720, and therefore the first locking lip 726 and the second locking lip 730, to move downwardly in the lifting bail receiving channel 332. More specifically, the upper surface 728 of the first locking lip 726 moves downwardly beneath the first and second vertically extending walls 316 and 320 of the first lifting bail guide 312. Additionally, the upper surface 732 of the second locking lip 730 moves downwardly beneath the first and second vertically extending walls of the second lifting bail guide 322.

The downwardly movement of the locking pin handle 540 also causes the encaser 570, the handle retention cap 600, and the locking indicator 630 to move downwardly. Consequently, this downwardly movement further causes the biasing member 660 to partially compress.

At this point, the locking pin handle 540 can then be rotated to the position shown in FIG. 14. This causes the first locking lip 726 to rotate out from the first locking lip chamber 314 and generally align with the first annular column 712, as shown in FIG. 7. Additionally, this causes the second locking lip 730 to rotate out from the second annular column and generally align with the second annular column 716, as shown in FIG. 7. At this point, the handle retention cap 600 covers the locking indicator 630 (i.e., the locking indicator 630 is not visible). This indicates that the lifting bail 500 is in the unlocked position. The lifting bail 500 can thus be removed from the void former 100.

It should be appreciated from the above that the present disclosure provides two sets of downwardly extending fins. In this embodiment, the first set of fins stops the over rotation of the locking pin 720. In this embodiment, once the locking pin 720 is engaged and locked into position, the other set of fins require the user to depress the locking pin 720 before the user can rotate the locking pin 720. This provides a safety feature that prevents accidental rotation of the locking pin 720.

The concrete slab 10 is lifted (as shown in FIG. 1) by first inserting and locking a plurality of lifting bails 500 in a plurality of respective embedded void formers 100. As described above, the lifting bail 500 can be easily and quickly inserted and locked in each respective void former 100. Additionally, the lifting bail 500 can be easily and quickly unlocked and removed from each respective void former 100. Unlike the prior art, the lifting bail 500 of the present disclosure does not need to be screwed and unscrewed for most of the length of the thickness of the concrete slab when inserting and removing the lifting bail 500 from the void former 100. Thus, repeatedly inserting, locking, unlocking, and removing a plurality of lifting bails 500 from a plurality of respective void formers 100 of the present disclosure is less-time consuming and laborious than what the prior art discloses.

HEIGHT ADJUSTMENT

As described above, after moving a concrete slab such as slab 10 onto a sub-grade, its height needs to be adjusted so that its top surface is level with the adjacent top surface of each of one or more adjacent concrete slabs, and additionally to create a void to allow permanent grout support to be pumped in under the concrete slab. The void former 100 of the present disclosure is also configured to be used to jack up and adjust the height of a concrete slab such as slab 10. How the void former 100 adjusts the height of the concrete is shown in FIG. 13 and will now be discussed.

Referring now to FIG. 13, after removing the lifting bail 500 from the void former 100, a jacking tool 800 is positioned in the lifting bail receiving channel 332 of the void former 100. An end of the jacking tool 800 engages the inner surface 210 that defines the drive tool receiving chamber of the head 206 of the already positioned jacking screw 200. The shape of the end of the jacking tool 800 corresponds to the shape of the drive tool receiving chamber. Thereafter, the jacking tool 800 is rotated to cause the jacking screw 200 to rotate and move downwardly.

Rotating the jacking screw 200 causes the breakable flange 291 of the lower housing 260 of the void former 100 to break. This enables the jacking screw 200 to continue to rotate and additionally move downwardly. The downwardly movement of the jacking screw 200 causes the jacking plate 110 to be released from the concrete slab 10. In other words, the jacking plate 110 moves downwardly beneath the bottom surface of the concrete slab 10 (such as the bottom surface 14 of the concrete slab 10 in FIGS. 1 and 2) to engage the sub-grade on which the concrete slab 10 rests. When the jacking plate 110 engages or is in engagement with the sub-grade, the jacking plate 110 does not substantially move downwardly. Thus, while the jacking screw 200 continues to move downwardly, an opposing force created by the jacking plate 110 engaging the sub-grade causes the jacking plate 1170, the lower housing 260, and the upper housing 290 of the void former 100 to move upwardly. As mentioned above, in an alternative embodiment, an upwardly extending tab from the jacking plate can be used to resist the rotational forces transferred to the jacking plate if the engagement in the sub-grade is not enough. This causes the concrete slab to move upwardly. In other words, the void former 100 causes the height of the concrete slab 10 to be adjusted. Once the height of the concrete slab 10 has been adjusted to a proper height, the jacking tool 800 can be quickly disengaged from the jacking screw 200. Thereafter, the concrete slab 10 and the void former 100 each stops moving.

The void former of the present disclosure is thus configured such that the jacking tool does not need to be screwed and unscrewed for most of the length of the thickness of the concrete slab when adjusting the height of the concrete slab. Thus, the void former of the present disclosure is configured so that adjusting the height of the concrete slab can be a less-time consuming and laborious process than what the prior art discloses.

ALTERNATIVE EMBODIMENTS

Figure 16:
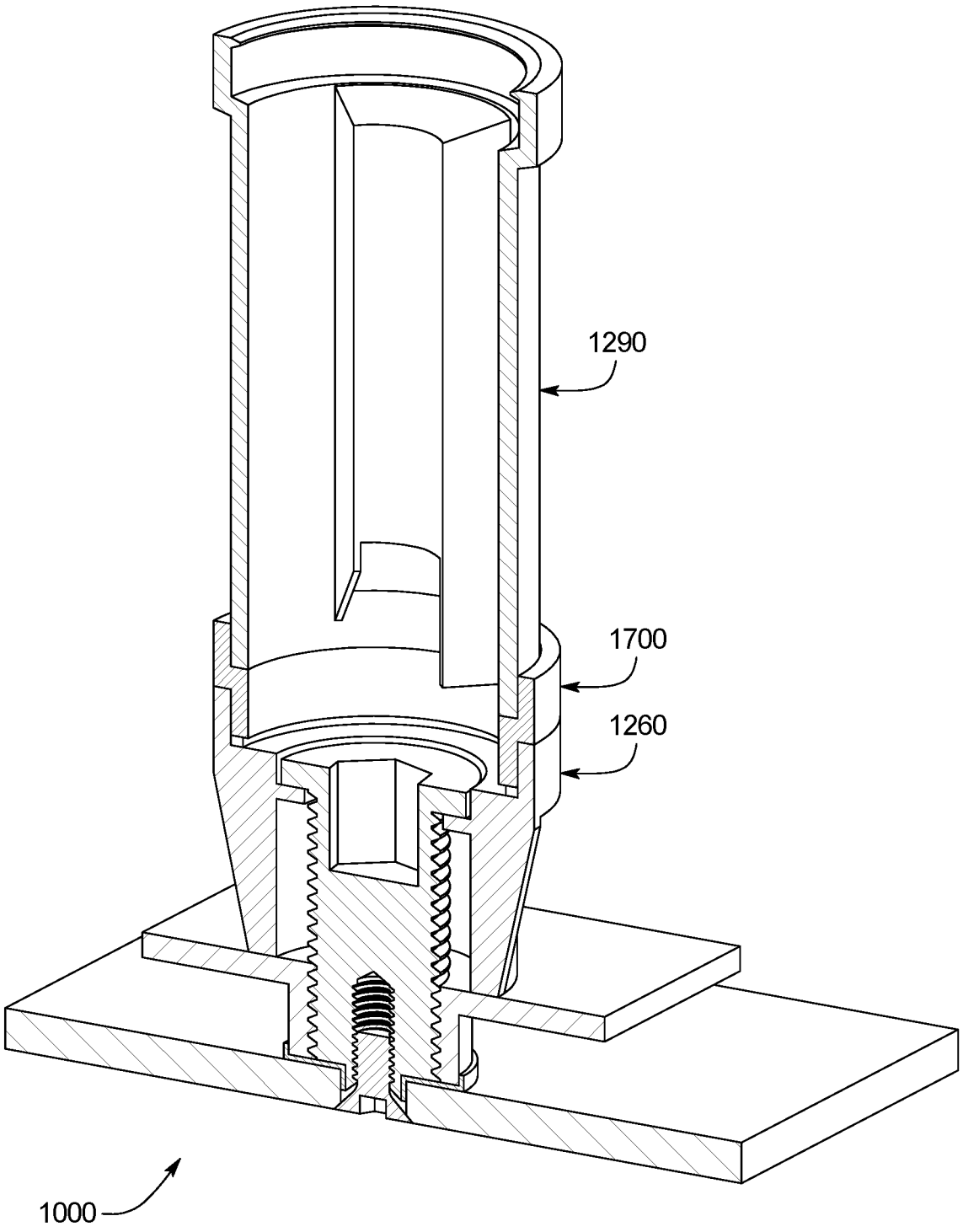
FIG. 16 is a perspective view of an alternative example embodiment of the lifting and jacking apparatus of the present disclosure, and particularly showing an alternative void former of the present disclosure.
Figure 17:
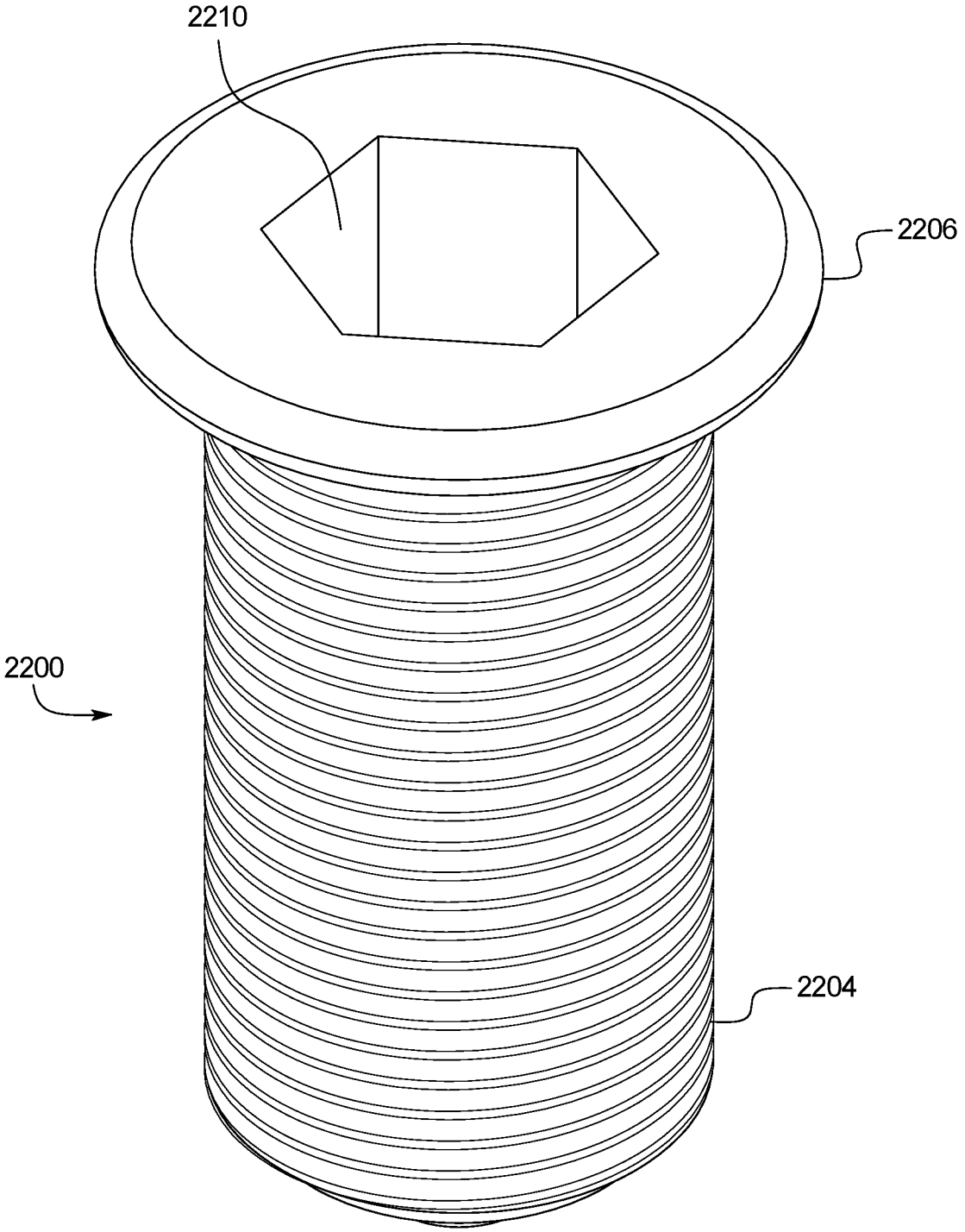
FIG. 17 is a perspective view of an alternative embodiment of the jacking screw of the present disclosure.
Figure 18:
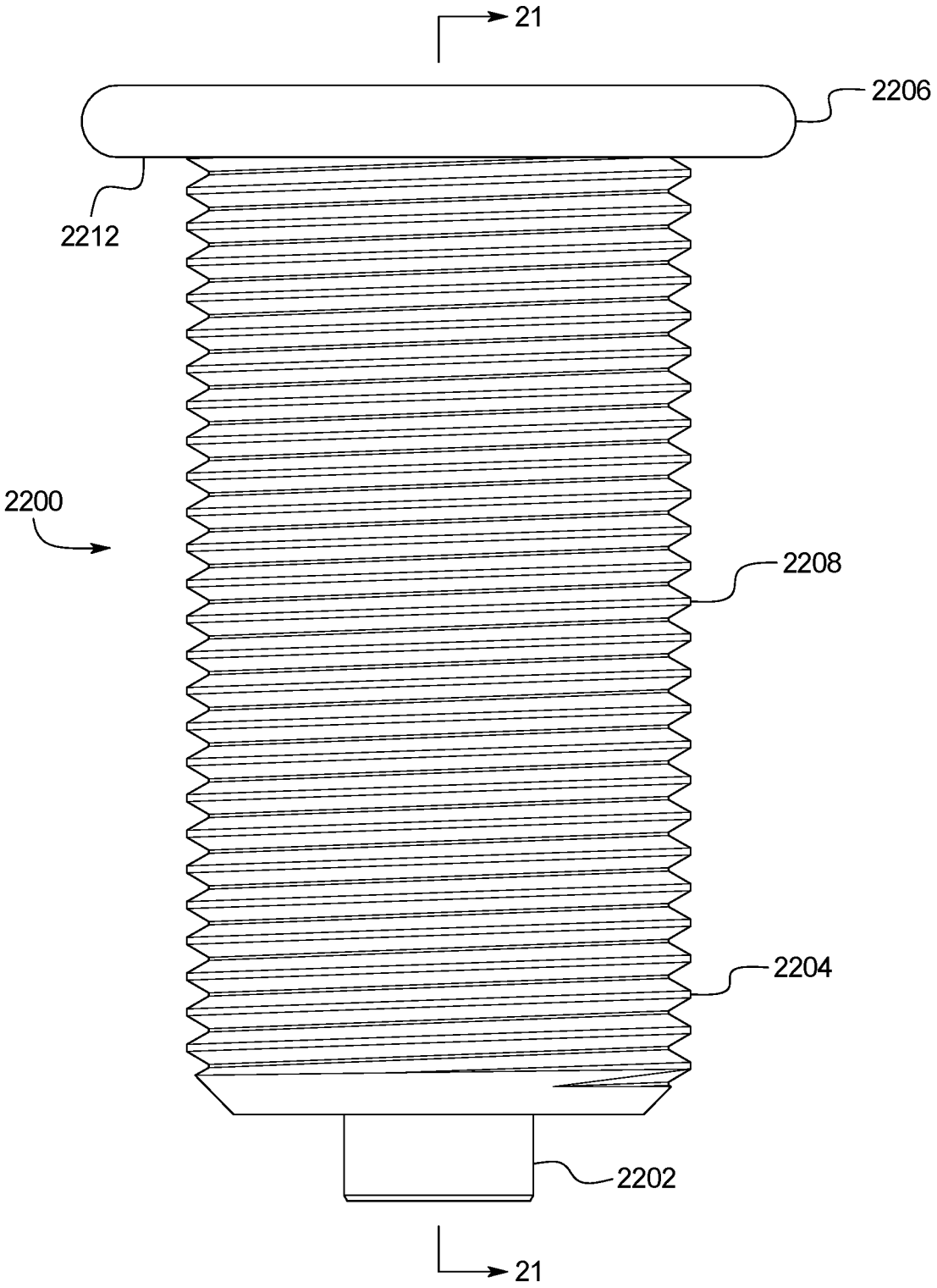
FIG. 18 is a side view of the jacking screw of FIG. 17.
Figure 19:
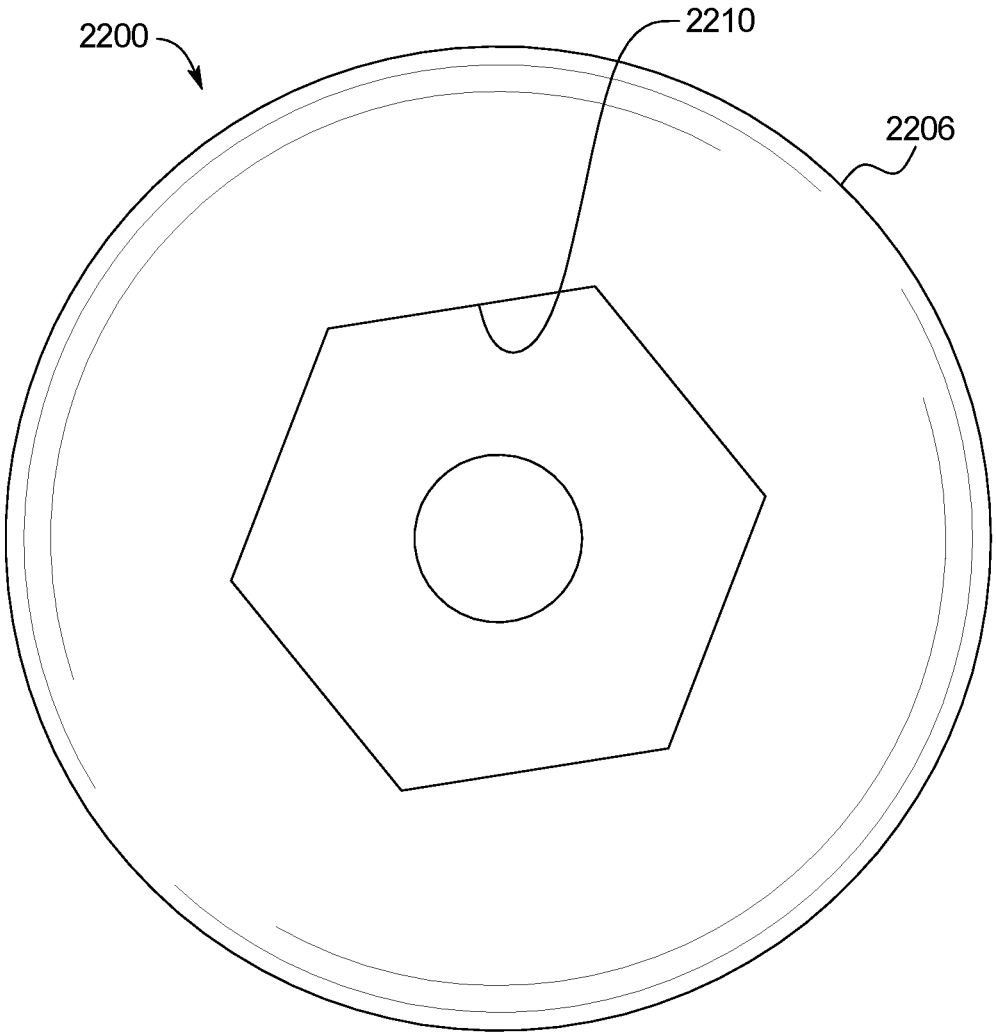
FIG. 19 is a top view of the jacking screw of FIG. 17.
Figure 20:
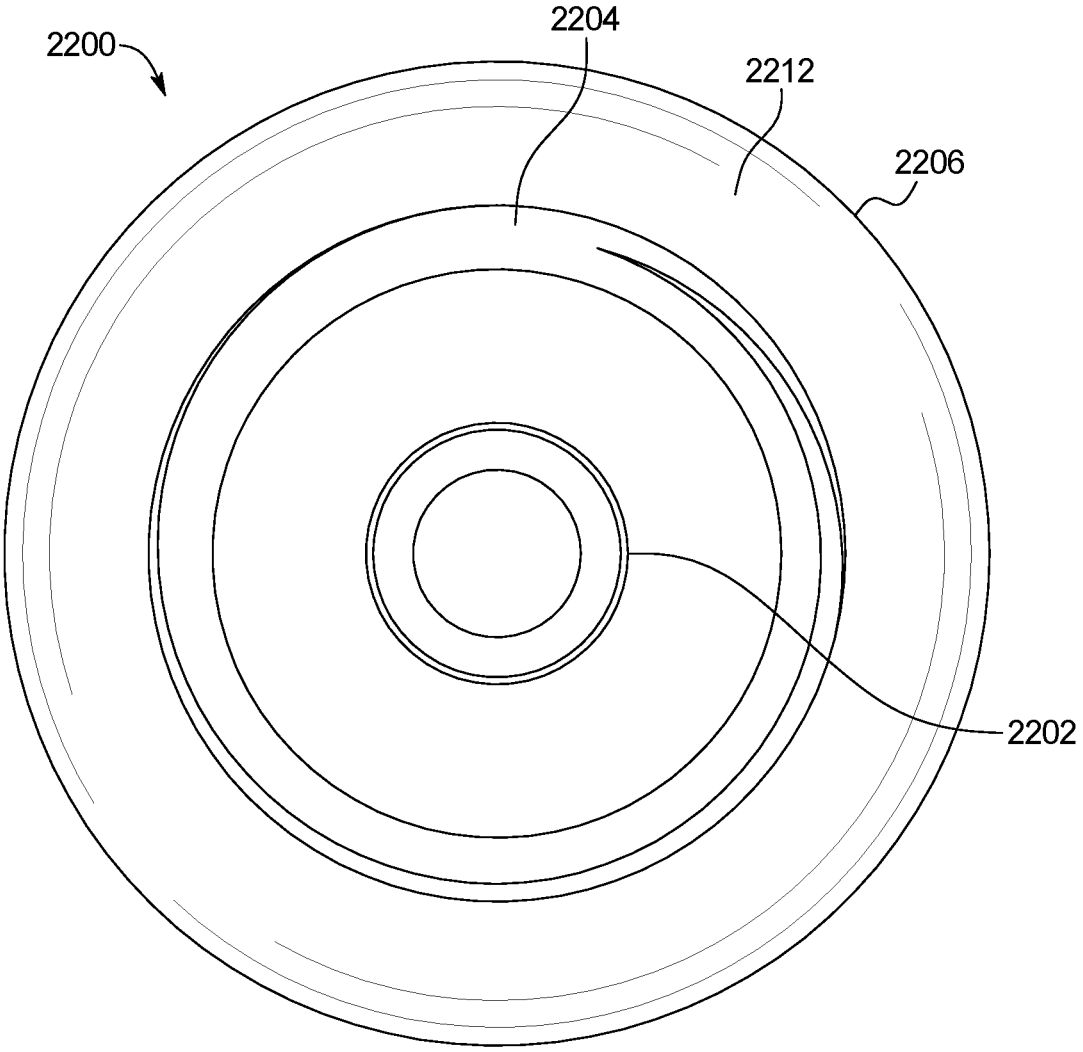
FIG. 20 is a bottom view of the jacking screw of FIG. 17.
Figure 21:
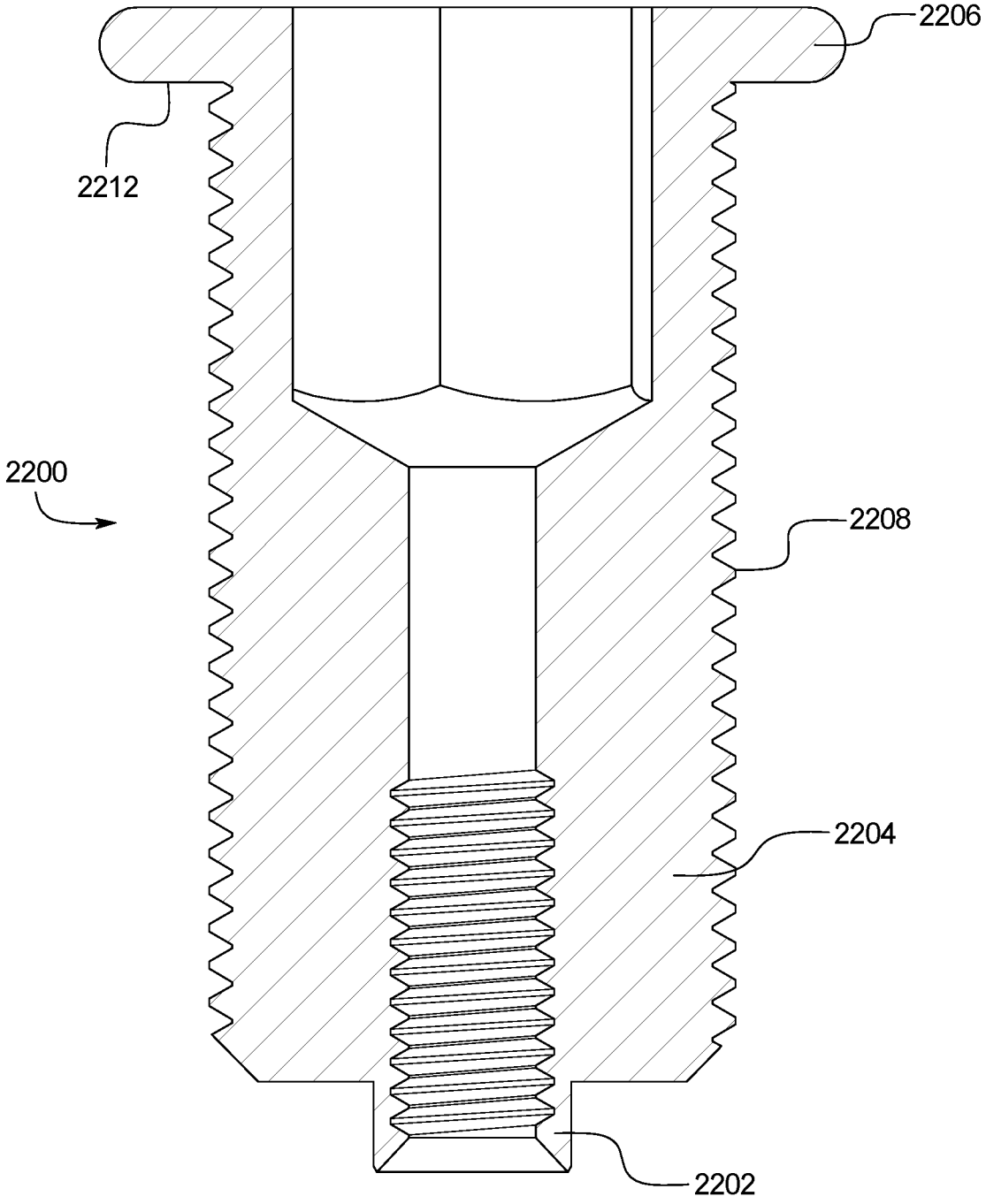
FIG. 21 is cross-sectional view of the jacking screw of FIG. 17, taken substantially along line 21-21 of FIG. 18.

The void former illustrated and described in FIGS. 1 to 15 is configured to assist in lifting and jacking a concrete slab such as a 7 inch thick concrete slab. It should be appreciated that alternative embodiments of the void former can be configured to assist in lifting and jacking a concrete slab of a different thickness. FIG. 16 shows an alternative example embodiment of the void former of the present disclosure configured to assist in lifting and jacking a concrete slab of a different thickness, and particularly of a greater thickness. The void former of this alternative example embodiment is identified by numeral 1000. To extend the length of the void former 1000 so that it is properly configured for a concrete slab having a greater thickness, the void former 1000 includes an extender 1700. The extender 1700 is positioned between a lower body 1260 and an upper body 1290. In certain embodiments, the extender 1700 can extend the length of the void former 1000 by one-half increments, such as by half an inch. In other certain embodiments, the extender 1700 can extend the length of the void former 1000 by one inch, one and a half inches, two inches, etc. In various embodiments, the extender 1700 is press fit between the lower housing 1260 and the upper housing 1290 of the void former 1000.

It should further be appreciated that in certain embodiments, the void former is configured to assist in lifting and jacking a concrete slab.

In other certain embodiments, the void former is configured to assist in lifting a concrete slab.

Figure 22:
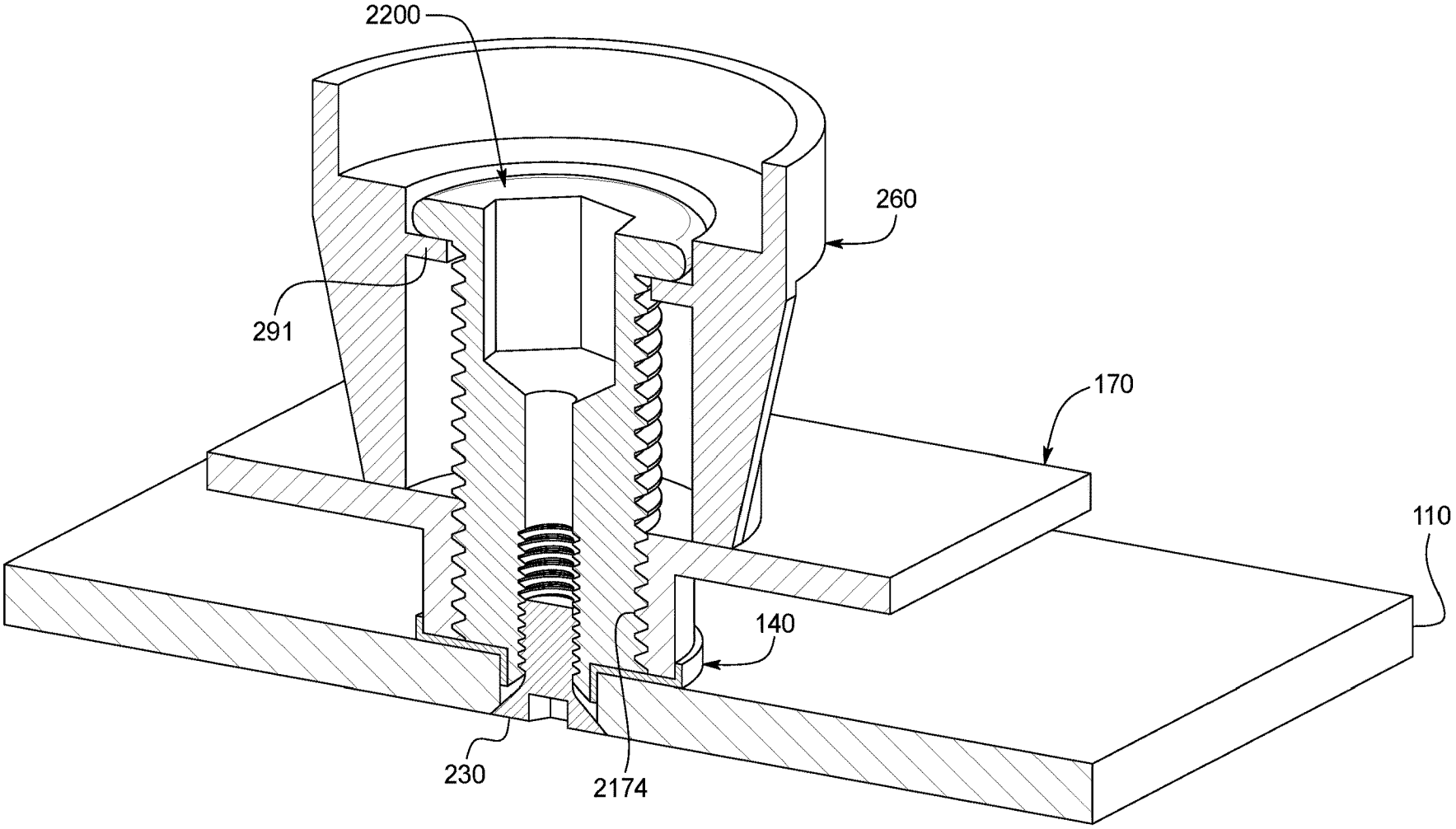
FIG. 22 is cross-sectional view of the jacking screw of FIG. 17, positioned in the jacking plate, the seal plate, the connecting plate, and the lower housing of the void former of FIGS. 1 and 2.

Referring now to FIGS. 17 to 22, an alternative embodiment of the jacking screw of the present disclosure is generally shown and indicated by numeral 2200. FIGS. 17 to 21 illustrate the jacking screw 2200 and FIG. 22 shows the jacking screw 2200 positioned in the jacking plate 110, the seal plate 140, the connecting plate 170, and the lower housing 260 of one embodiment of the void former of the present disclosure.

Like jacking screw 200, jacking screw 2200 is configured to assist in adjusting the height of the concrete slab. Like jacking screw 200, jacking screw 2200 can be considered implanted or permanent because it is part of the embedded void former (as opposed to prior known void formers which do not include such implanted jacking screw(s)). More specifically, the jacking screw 2200 is configured to be rotatable within and moveable downwardly (and thereafter upwardly) within the jacking plate 110, the seal plate 140, the connecting plate 170, and the lower housing 260 to cause the jacking plate 110 to move downwardly relative to the concrete slab. This causes the height of the concrete slab to be adjusted as explained above.

More specifically, like jacking screw 200, jacking screw 2200 includes a cylindrical lower end 2202, a cylindrical shaft 2204 connected to the lower end 2202, and a cylindrical head 2206 connected to the shaft 2204. The lower end 2202, the shaft 2204, and the head 2206 are all integrally connected in this illustrated example embodiment. The lower end 2202 of the jacking screw 2200 is configured to be positioned in the top portion of the bottom fastener opening of the jacking plate 110 and in the seal plate 140, as best shown in FIG. 22. The shaft 2204 includes outwardly extending helical threads 2208. The threads 2208 are configured to threadably engage complementary inwardly extending threads 2174 of the connecting plate 170, as best shown in FIG. 22. The shaft 2204 and the head 2206 of the jacking screw 2200 include an inner hexagonal surface 2210 that defines a depressed hex drive tool receiving chamber. This provides an internal drive for the jacking screw 2200. It should be appreciated that the drive tool receiving chamber could be other otherwise configured such as by having a square shape, a six point shape for a TORX type tool, etc. It should also be appreciated that the head can alternatively be configured to have a suitable external shape such as hex shape that can be driven via a socket spanner type drive tool. The drive tool receiving chamber is configured to receive a driving tool such as a jacking tool and particularly such as the jacking tool 800 shown in FIG. 13. The head 2206 of the jacking screw 2200 has a larger outer diameter than the outer diameter of the shaft 2204. A lower surface 2212 of the head 2206 is configured to engage and be supported by a breakable flange 291 of the lower housing 260 of the void former 100 to assist in holding the components of the void former together after assembly, during the embedding process, and until the jacking process is initiated. Additionally, the lower end 2202 and the shaft 2204 include a vertically extending centrally positioned cylindrical threaded inner surface that defines a bottom fastener receiving chamber. The bottom fastener receiving chamber is configured to threadably receive the bottom fastener 230 to assist in holding the components of the void former together (as shown in FIG. 22) after assembly, during the embedding process, and until the jacking process is initiated. The bottom fastener 230 is configured to be inserted into the bottom fastener opening of the jacking plate 110 and threadably received in the bottom fastener chamber of the jacking screw 2200.

In this illustrated example embodiment, the cylindrical head 2206 of the jacking screw 2200 is relatively thinner than or has a smaller height than the head 206 of the jacking screw 200. In various embodiments, the cylindrical head 2206 has a thickness of less than or equal to 4.5 millimeters. In this illustrated example embodiment, the cylindrical head 2206 has a 3 millimeter thickness.

In this illustrated example embodiment, the shaft 2204 of the jacking screw 2200 has a relatively wide outer diameter compared to the longitudinal length of the jacking screw 2200. In various embodiments, the jacking screw has a longitudinal length of a minimum of 55 millimeters. In various embodiments, the outer diameter of the shaft is at least 19 millimeters. In this illustrated example embodiment, the shaft 2204 has a 23 millimeter outer diameter and the jacking screw 2200 has a 62.45 millimeter longitudinal length.

In this illustrated embodiment, the jacking screw 2200 has a relatively small pitch angle for the threads. The pitch angle is the angle the threads are orientated relative to the horizontal (i.e., perpendicular to the thread length). In this illustrated example embodiment, the jacking screw 2200 has a 60 degree pitch angle for the threads. In other words, the thread angle is the angle from 1 flank of the thread to the other which in this example is 60 degrees. This relatively low angle provides for better or enhanced load carrying.

In this illustrated example embodiment, the threads 2208 are fine or closer to each other than the threads 208 of jacking screw 200. In other words, in this illustrated example embodiment, the threads 2208 have a smaller pitch (i.e., the distance from the crest of one thread to the crest of the adjacent thread) than the threads 208 of jacking screw 200. In various embodiments, the pitch is less than 10% of the nominal external or outer diameter. Specifically, in this illustrated example embodiment, the threads 2208 of shaft 2204 have a 2 millimeter pitch.

This small pitch provides a relatively small lead (i.e., a linear distance the screw travels in one revolution) in relation to the thread diameter. In this example embodiment, the jacking screw 2200 has a M27×2 thread die and for every rotation, the linear movement is 2 millimeters. In various embodiments, the lead per rotation is less than or equal to 2 mm.

Thus, it should be appreciated that in certain embodiments, the cylindrical head has a thickness of less than or equal to 4.5 millimeters, the shaft has a minimum outer diameter of 22 millimeters, the jacking screw has a longitudinal length of a minimum of 55 millimeter, and the threads have a pitch of less than 10% of the nominal thread diameter.

It should be appreciated that in certain embodiments, the cylindrical head has a thickness of less than or equal to 4.5 millimeters, the shaft has a minimum outer diameter of 22 millimeters, the jacking screw has a longitudinal length of a minimum of 55 millimeters, and the threads have a pitch of less than 10% of the nominal thread diameter.

It should further be appreciated that in certain embodiments, the cylindrical head has a thickness of 2.5 to 5 millimeters, the shaft has a minimum outer diameter of 22 to 30 millimeters, the jacking screw has a longitudinal length of a minimum of 55 to 70 millimeters, and the threads have a pitch of 6 to 10% of the nominal thread diameter.

The jacking screw 2200 is thus configured to achieve various specific functions whiles still fitting in the limited space available. The combination of these specific features along with the internal drive chamber, provide the jacking screw 2200 with the ability to convert a relatively significant amount of rotational movement on the jacking screw 2200 to a relatively small amount of linear movement of the jacking screw 2200 and also provide a relatively large amount of linear force exerted by the jacking plate for a relatively low applied torque which enables movement of and more controlled movement of the concrete slab.

This configuration also enables a battery powered impact wrench with limited torque capacity to be employed to rotate the jacking screw 2200.

It should be appreciated from the above that in various embodiments, the present disclosure provides a void former configured for embedment in a concrete slab, said void former comprising: a jacking plate; a connecting plate including a body having a threaded inner surface defining a jacking screw channel; a jacking screw threadably rotatable in the jacking screw channel; a lower housing; and an upper housing connectable to the lower housing and configured to releasably and securely receive a lifting bail.

In various such embodiments, the jacking screw includes a lower end rotatable in an opening in the jacking plate.

In various such embodiments, the jacking screw defines a drive tool receiving chamber.

In various such embodiments, the lower housing includes a breakable flange engagable by the jacking screw when the jacking screw, the lower housing, the jacking plate, and the connecting plate are held together by the fastener.

In various such embodiments, a rotation of the jacking screw relative to the lower housing is configured to cause the breakable flange to break.

In various such embodiments, the void former includes a seal plate positionable between the jacking plate and the connecting plate.

In various such embodiments, the void former includes a removable cap removably attachable to the upper housing.

In various such embodiments, the jacking plate includes an upwardly extending tab.

In various such embodiments, the void former includes a fastener connectable to the jacking plate to secure the jacking screw, the lower housing, the jacking plate, and the connecting plate together for embedding in a concrete slab.

It should also be appreciated from the above that in various embodiments, the present disclosure provides a lifting bail removably insertable in and lockable in a void filler, lifting bail comprising: a main stem; a rotatable locking pin; a locking pin handle connected to the rotatable locking pin; a locking indicator; and a biasing member journaled about the rotatable locking pin and configured to bias the locking indicator toward a visible position to indicate that the lifting bail is in a locked position; and a lifting handle connected to the rotatable locking pin.

In various such embodiments, the locking pin handle is rotatable to cause the locking pin to rotate from an unlocked position to the locked position.

It should further be appreciated from the above that in various embodiments, the present disclosure provides a void filler jacking screw comprising: a cylindrical lower end, the lower end configured to be positioned in a top portion of a bottom fastener opening of a jacking plate of a void former and in a seal plate of the void former; a cylindrical shaft integrally connected to the lower end, the shaft including outwardly extending helical threads configured to threadably engage complementary inwardly extending threads of a connecting plate of the void former, the lower end and the shaft including a vertically extending centrally positioned cylindrical threaded inner surface that defines a bottom fastener receiving chamber configured to threadably receive a bottom fastener of the void filler; and a cylindrical head integrally connected to the shaft, the shaft and the head including an inner surface that defines a depressed drive tool receiving chamber configured to receive a driving tool, the head having a larger outer diameter than an outer diameter of the shaft and configured to engage a breakable flange of a lower housing of the void former.

In various such embodiments, the cylindrical head has a thickness of less than or equal to 4.5 millimeters, the shaft has a minimum outer diameter of 22 millimeters, the jacking screw has a longitudinal length of a minimum of 55 millimeter, and the threads have a pitch of less than 10% of the nominal thread diameter.

In various such embodiments, the cylindrical head has a thickness of less than or equal to 4.5 millimeters, the shaft has a minimum outer diameter of 22 millimeters, the jacking screw has a longitudinal length of a minimum of 55 millimeters, and the threads have a pitch of less than 10% of the nominal thread diameter.

In various such embodiments, the cylindrical head has a thickness of 2.5 to 5 millimeters, the shaft has a minimum outer diameter of 22 to 30 millimeters, the jacking screw has a longitudinal length of a minimum of 55 to 70 millimeters, and the threads have a pitch of 6 to 10% of the nominal thread diameter.

Various changes and modifications to the above-described embodiments described herein will be apparent to those skilled in the art. These changes and modifications can be made without departing from the spirit and scope of this present subject matter and without diminishing its intended advantages. Not all of the depicted components described in this disclosure may be required, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. Also, unless otherwise indicated, any directions referred to herein reflect the orientations of the components shown in the corresponding drawings and do not limit the scope of the present disclosure. This specification is intended to be taken as a whole and interpreted in accordance with the principles of the invention as taught herein and understood by one of ordinary skill in the art.

The invention is claimed as follows:

1. A lifting bail removably insertable into and lockable in a void former, the lifting bail comprising:

a main stem insertable into the void former, the main stem including an upwardly extending head that includes: (a) a vertically extending inner wall that partially defines a vertically extending central locking pin channel, (b) a horizontally extending planar wall, and (c) a vertically extending wall that extends upwardly from the planar wall, wherein the planar wall and the vertically extending inner wall define a housing chamber;

a rotatable locking pin insertable into the void former;

a locking pin handle connected to the locking pin;

a locking indicator, wherein the housing chamber at least partially holds the locking indicator;

a biasing member journaled about the locking pin and positioned to bias the locking indicator toward a visible position to indicate that the locking pin is in a locked position, wherein the housing chamber at least partially holds the biasing member; and a lifting handle connected to the locking pin.

2. The lifting bail of claim 1, wherein the locking pin handle is rotatable to cause the locking pin to rotate from an unlocked position to the locked position.

3. The lifting bail of claim 1, wherein the head includes an inwardly extending stopping lip engagable by the locking indicator to limit upward movement of the locking indicator.

4. The lifting bail of claim 3, which includes an encaser and a handle retention cap at least partially covering the locking indicator and at least partially supporting the lifting handle, wherein the encaser is rotatable about the locking pin and the encaser is moveable upwardly and downwardly along a length of the locking pin, wherein when the handle retention cap moves upwardly the encaser also moves upwardly, wherein when the handle retention cap moves downwardly the encaser also moves downwardly, and wherein when the encaser rotates the handle retention cap rotates with the rotation of the encaser.

5. The lifting bail of claim 4, wherein the handle retention cap includes a vertically extending outer wall having a lower surface engageable by an upper surface of the main stem when the locking pin is in the unlocked position.

6. The lifting bail of claim 5, wherein the handle retention cap includes a first horizontally extending lifting handle engaging wall and a second opposing horizontally extending lifting handle engager wall.

7. The lifting bail of claim 5, wherein the biasing member biases the locking pin, the locking indicator, the handle retention cap, the encaser, and the locking pin handle upwardly.

8. The lifting bail of claim 5, wherein the biasing member includes an upper portion that engages and applies an upward biasing force against a bottom surface of the locking indicator.

9. The lifting bail of claim 5, wherein the biasing member is in the housing chamber defined by the head of the main stem.

10. The lifting bail of claim 5, wherein the locking indicator is upwardly movable to a visible position to indicate that the locking pin is in the locked position.

11. The lifting bail of claim 5, wherein the locking indicator includes a horizontally extending upper wall, the locking indicator includes a downwardly extending main stem engager wall connected and extending downwardly from the upper wall, the main stem engager wall includes an outwardly extending stopping lip, the stopping lip configured to engage the stopping lip of the head of the main stem.

12. The lifting bail of claim 5, wherein the locking indicator includes a central wall extending downwardly from the upper wall of the locking indicator, the central wall including an inner surface that partially defines the locking pin channel and partially receives the biasing member.

13. A lifting bail removably insertable into and lockable in a void former, the lifting bail comprising:

a main stem insertable into the void former;

a rotatable locking pin insertable into the void former;

a locking pin handle connected to the locking pin and rotatable to cause the locking pin to rotate from an unlocked position to a locked position;

a locking indicator;

a biasing member journaled about the locking pin, the biasing member positioned to bias the locking pin upwardly, to bias the locking pin handle upwardly, and to bias the locking indicator upwardly toward a visible position to indicate that the locking pin is in the locked position;

a lifting handle connected to the locking pin;

an encaser; and a handle retention cap at least partially covering the locking indicator, at least partially support the lifting handle, and cover a bottom portion of the encaser.

14. The lifting bail of claim 13, wherein the main stem includes an upwardly extending head that at least partially receives the locking indicator and the biasing member.

15. The lifting bail of claim 14, wherein the head includes an inwardly extending stopping lip engageable by the locking indicator to limit the upward movement of the locking indicator.

16. The lifting bail of claim 15, wherein the encaser is rotatable about the locking pin, the encaser is moveable upwardly and downwardly along a length of the locking pin, wherein when the handle retention cap moves upwardly the encaser also moves upwardly, wherein when the handle retention cap moves downwardly the encaser also moves downwardly, and wherein when the encaser rotates the handle retention cap rotates with the rotation of the encaser.

17. The lifting bail of claim 16, wherein the handle retention cap includes a vertically extending outer wall having a lower surface engageable by an upper surface of the main stem when the locking pin is in the unlocked position.

18. The lifting bail of claim 17, wherein the handle retention cap includes a first lifting handle engaging wall and a second opposing lifting handle engager wall.

19. The lifting bail of claim 15, wherein the biasing member is in the housing chamber defined by the head of the main stem.

* * * * *